US011100758B2

(12) United States Patent
Baggesen-Jensen et al.

(10) Patent No.: US 11,100,758 B2
(45) Date of Patent: Aug. 24, 2021

(54) SYSTEM AND METHOD FOR IMPLEMENTING A LOTTERY GAME

(71) Applicant: IGT, Las Vegas, NV (US)

(72) Inventors: Janna Baggesen-Jensen, Las Vegas, NV (US); Anthony Baerlocher, Henderson, NV (US); Kyle Rothchild, Carson City, NV (US)

(73) Assignee: IGT, Las Vegas, NV (US)

( * ) Notice: Subject to any disclaimer, the term of this patent is extended or adjusted under 35 U.S.C. 154(b) by 16 days.

(21) Appl. No.: 16/419,531

(22) Filed: May 22, 2019

(65) Prior Publication Data

US 2020/0372747 A1 Nov. 26, 2020

(51) Int. Cl.
*G07F 17/32* (2006.01)

(52) U.S. Cl.
CPC ..... *G07F 17/329* (2013.01); *G07F 17/3209* (2013.01); *G07F 17/3211* (2013.01); *G07F 17/3225* (2013.01); *G07F 17/3241* (2013.01); *G07F 17/3244* (2013.01)

(58) Field of Classification Search
CPC ..... G07F 17/329; G07F 17/3209; G07F 17/3211; G07F 17/3225; G07F 17/3241; G07F 17/3244
See application file for complete search history.

(56) References Cited

U.S. PATENT DOCUMENTS 6,149,522 A * 11/2000 Alcorn ..... G06Q 50/34 463/29
6,685,567 B2 * 2/2004 Cockerille ..... G07F 17/32 463/16
6,722,985 B2 * 4/2004 Criss-Puszkiewicz ..... G07F 17/32 273/148 B
6,804,763 B1 * 10/2004 Stockdale ..... G07F 17/3241 463/24
6,863,608 B1 * 3/2005 LeMay ..... G07F 17/32 463/20
6,908,387 B2 * 6/2005 Hedrick ..... G07F 17/0014 463/31
6,962,530 B2 * 11/2005 Jackson ..... G07F 17/32 463/29
7,043,641 B1 * 5/2006 Martinek ..... G06F 21/123 380/251
7,111,141 B2 * 9/2006 Nelson ..... A63F 13/12 711/170
7,201,662 B2 * 4/2007 LeMay ..... G06F 21/57 463/20
7,311,605 B2 * 12/2007 Moser ..... G07F 17/32 463/25
7,384,339 B2 * 6/2008 LeMay ..... G07F 17/32 463/16
7,515,718 B2 * 4/2009 Nguyen ..... G06F 21/10 380/278

(Continued)

*Primary Examiner* — David L Lewis
*Assistant Examiner* — Matthew D Hoel
(74) *Attorney, Agent, or Firm* — Sheridan Ross P.C.

(57) ABSTRACT

The present disclosure relates generally to a gaming device that facilitates user interactions with multiple games. Illustratively, a method of facilitating a lottery game is provided that includes receiving, from a gaming device, an indication of an outcome of a game that was executed by the gaming device, identifying a user of the gaming device when the outcome of the game occurred, then assigning a lottery number to the user of the gaming device for a next execution of the lottery game, where the lottery number is selected based on the outcome of the game.

14 Claims, 10 Drawing Sheets

(56) References Cited

U.S. PATENT DOCUMENTS

| | | | | |
|---|---|---|---|---|
| 7,585,223 | B2 * | 9/2009 | Iddings | G07F 17/32 463/27 |
| 7,611,411 | B2 * | 11/2009 | Griswold | G07F 17/32 463/1 |
| 7,617,151 | B2 * | 11/2009 | Rowe | G06Q 20/10 705/35 |
| 7,651,392 | B2 * | 1/2010 | Pennington | G07F 17/34 463/16 |
| 7,666,093 | B2 * | 2/2010 | Lafky | G07F 17/3258 463/26 |
| 7,780,523 | B2 * | 8/2010 | Baerlocher | G07F 17/32 463/26 |
| 8,012,011 | B2 * | 9/2011 | Baerlocher | G07F 17/34 463/20 |
| 8,057,298 | B2 * | 11/2011 | Nguyen | G07F 17/3281 463/25 |
| 8,070,583 | B2 * | 12/2011 | Baerlocher | G07F 17/3246 463/16 |
| 8,147,334 | B2 * | 4/2012 | Gatto | G07F 17/3244 463/40 |
| 8,241,104 | B2 * | 8/2012 | Wolf | G07F 17/32 463/20 |
| 8,337,298 | B2 * | 12/2012 | Baerlocher | G07F 17/3276 463/25 |
| 8,430,739 | B2 * | 4/2013 | Rodgers | G07F 17/32 463/20 |
| 8,500,548 | B2 * | 8/2013 | Baerlocher | G07F 17/3244 463/25 |
| 8,562,423 | B2 * | 10/2013 | Wolf | G07F 17/32 463/25 |
| 8,627,097 | B2 * | 1/2014 | Wolf | G06F 21/51 713/187 |
| 8,764,566 | B2 * | 7/2014 | Miltenberger | G07F 17/3255 463/42 |

* cited by examiner

SYSTEM AND METHOD FOR IMPLEMENTING A LOTTERY GAME

BACKGROUND

The present disclosure is directed toward a lottery game and, in particular, a modified lottery game that is improved by operation of gaming machines, such as slot machines.

Slot machines represent an opportunity to win at a game of chance, sometimes immediately. Lottery drawings, in contrast, normally occur periodically and there is often a delay between a user receiving their lottery numbers and the winning lottery numbers being drawn. A significant attraction to lottery games, however, is the possibility of large jackpots and an extended sense that the user has some control over their output because the lottery numbers can be selected by the user.

BRIEF SUMMARY

In certain embodiments, the present disclosure relates to a method of facilitating user interactions with a gaming device. In some embodiments, the method includes receiving a first user input at the gaming device, where the first user input includes an indication of a wager amount desired by a user for a first game executed by the gaming device. The method may further include invoking, with a processor of the gaming device, a random number generator to generate an outcome for the first game, providing, with the processor, an output to the user that indicates the outcome for the first game, and then determining, with the processor, that the outcome for the first game qualifies the user to receive an award that is an input for a secondary game, where the secondary game is different from the first game, and where the input for the secondary game includes a lottery number. The method may further include providing, with the processor, a query to the user requesting whether the user desires to redeem the award, receiving a second user input at the gaming device, where the second user input includes a response to the query, and in response to receiving the second user input, generating an output at the gaming device for a server that manages the secondary game, where the output comprises an indication that the user has redeemed the award.

In some embodiments, the present disclosure also relates to a server including a communication interface connectable with a communication network, a processor coupled with the communication interface, and a computer-readable storage medium, coupled with the processor, including instructions that are executable by the processor. In some embodiments, the instructions include: instructions that execute a lottery game; instructions that receive, from a gaming device via the communication interface, an indication of an outcome of a game that was executed by the gaming device; instructions that identify a user of the gaming device when the outcome of the game occurred; instructions that assign a lottery number to the user of the gaming device for a next execution of the lottery game, where the lottery number is selected based on the outcome of the game; instructions that store the lottery number assigned to the user with a set of lottery numbers inclusive of the lottery number; instructions that compare a set of winning lottery numbers determined from the next execution of the lottery game with the set of lottery numbers inclusive of the lottery number; and instructions that notify the user in response to the set of winning lottery numbers matching the set of lottery numbers inclusive of the lottery number.

In some embodiments, the present disclosure also relates to a method of facilitating a lottery game that includes executing, with a processor, instructions for a lottery game. The method may further include receiving, from a gaming device at the processor, an indication of an outcome of a game that was executed by the gaming device, identifying, with the processor, a user of the gaming device when the outcome of the game occurred, and assigning, with the processor, a lottery number to the user of the gaming device for a next execution of the lottery game, where the lottery number is selected based on the outcome of the game. In some embodiments, the method may further include storing, with the processor, the lottery number assigned to the user with a set of lottery numbers inclusive of the lottery number, comparing, with the processor, a set of winning lottery numbers determined from the next execution of the lottery game with the set of lottery numbers inclusive of the lottery number, and notifying, with the processor, the user in response to the set of winning lottery numbers matching the set of lottery numbers inclusive of the lottery number.

Additional features and advantages are described herein and will be apparent from the following Description and the figures.

DETAILED DESCRIPTION

Figure 1:
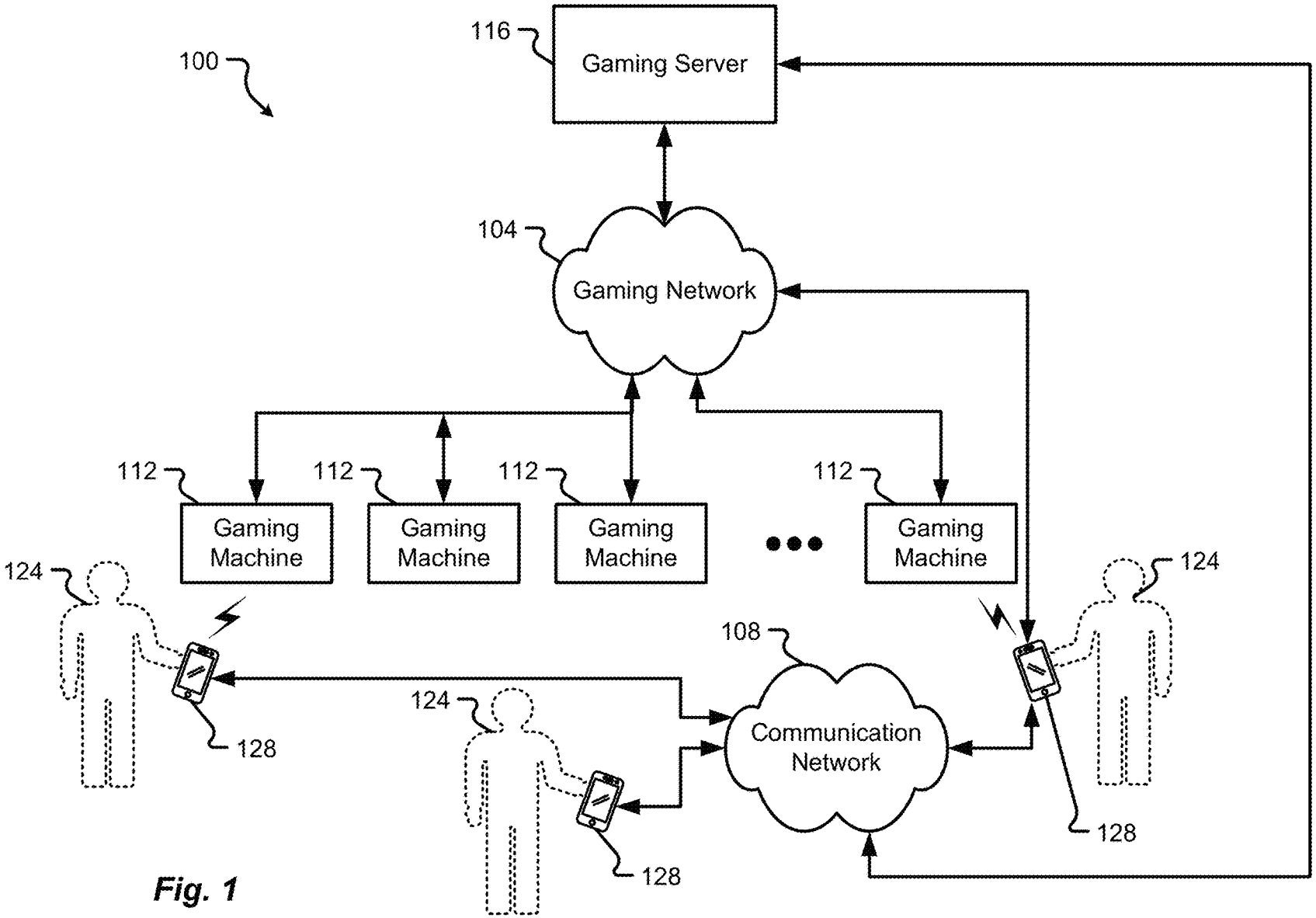
FIG. 1 illustrates a gaming system in accordance with embodiments of the present disclosure.

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices. Moreover, an Electronic Gaming Machine (EGM) as used herein refers to any suitable electronic gaming machine which enables a player to play a game (including but not limited to a game of chance, a game of skill, and/or a game of partial skill) to potentially win one or more awards, wherein the EGM comprises, but is not limited to: a slot machine, a video poker machine, a video lottery terminal, a terminal associated with an electronic table game, a video keno machine, a video bingo machine located on a casino floor, a sports betting terminal, or a kiosk.

In various embodiments, the gaming system of the present disclosure includes: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, "EGM" as used herein represents one EGM or a plurality of EGMs, "personal gaming device" as used herein represents one personal gaming device or a plurality of personal gaming devices, and "central server, central controller, or remote host" as used herein represents one central server, central controller, or remote host or a plurality of central servers, central controllers, or remote hosts. A "gaming device" as used herein may be understood to include an EGM, multiple EGMs, a personal gaming device, multiple personal gaming devices, a mobile device, multiple mobile devices, or combinations thereof.

As noted above, in various embodiments, the gaming system includes a gaming device in combination with a central server, central controller, or remote host. In such embodiments, the EGM (or gaming device) is configured to communicate with the central server, central controller, or remote host through a data network or remote communication link. In certain such embodiments, the EGM (or gaming device) is configured to communicate with another EGM (or gaming device) through the same data network or remote communication link or through a different data network or remote communication link. For example, the gaming system includes a plurality of gaming devices that are each configured to communicate with a central server, central controller, or remote host through a data network.

In certain embodiments in which the gaming system includes a gaming device in combination with a central server, central controller, or remote host, the central server, central controller, or remote host is any suitable computing device (such as a server) that includes at least one processor and at least one memory device or data storage device. As further described herein, the EGM (or gaming device) includes at least one EGM (or gaming device) processor configured to transmit and receive data or signals representing events, messages, commands, or any other suitable information between the EGM (or gaming device) and the central server, central controller, or remote host. The at least one processor of that EGM (or gaming device) is configured to execute the events, messages, or commands represented by such data or signals in conjunction with the operation of the EGM (or gaming device). Moreover, the at least one processor of the central server, central controller, or remote host is configured to transmit and receive data or signals representing events, messages, commands, or any other suitable information between the central server, central controller, or remote host and the EGM (or gaming device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or gaming device). Further, one, more than one, or each of the functions of the at least one processor of the EGM (or gaming device) may be performed by the at least one processor of the central server, central controller, or remote host.

In certain such embodiments, computerized instructions for controlling any games (such as any primary or base games and/or any secondary or bonus games) displayed by the EGM (or gaming device) are executed by the central server, central controller, or remote host. In such "thin client" embodiments, the central server, central controller, or remote host remotely controls any games (or other suitable interfaces) displayed by the EGM (or gaming device), and the EGM (or gaming device) is utilized to display such games (or suitable interfaces) and to receive one or more inputs or commands. In other such embodiments, computerized instructions for controlling any games displayed by the EGM (or gaming device) are communicated from the central server, central controller, or remote host to the EGM (or gaming device) and are stored in at least one memory device of the EGM (or gaming device). In such "thick client" embodiments, the at least one processor of the EGM (or gaming device) executes the computerized instructions to control any games (or other suitable interfaces) displayed by the EGM (or gaming device).

In various embodiments in which the gaming system includes a plurality of EGMs (or gaming devices), one or more of the EGMs (or gaming devices) are thin client EGMs (or gaming devices) and one or more of the EGMs (or gaming devices) are thick client EGMs (or gaming devices). In other embodiments in which the gaming system includes one or more EGMs (or gaming devices), certain functions of one or more of the EGMs (or gaming devices) are implemented in a thin client environment, and certain other functions of one or more of the EGMs (or gaming devices) are implemented in a thick client environment. In one such embodiment in which the gaming system includes an EGM (or gaming device) and a central server, central controller, or remote host, computerized instructions for controlling any primary or base games displayed by the EGM (or gaming device) are communicated from the central server, central controller, or remote host to the EGM (or gaming device) in a thick client configuration, and computerized instructions for controlling any secondary or bonus games or other functions displayed by the EGM (or gaming device) are executed by the central server, central controller, or remote host in a thin client configuration.

In certain embodiments in which the gaming system includes: (a) an EGM (or gaming device) configured to communicate with a central server, central controller, or remote host through a data network; and/or (b) a plurality of EGMs (or gaming devices) configured to communicate with one another through a communication network, the communication network may include a local area network (LAN) in which the EGMs (or gaming devices) are located substantially proximate to one another and/or the central server, central controller, or remote host. In one example, the EGMs (or gaming devices) and the central server, central controller, or remote host are located in a gaming establishment or a portion of a gaming establishment.

In other embodiments in which the gaming system includes: (a) an EGM (or gaming device) configured to communicate with a central server, central controller, or remote host through a data network; and/or (b) a plurality of EGMs (or gaming devices) configured to communicate with one another through a communication network, the communication network may include a wide area network (WAN) in which one or more of the EGMs (or gaming devices) are not necessarily located substantially proximate to another one of the EGMs (or gaming devices) and/or the central server, central controller, or remote host. For example, one or more of the EGMs (or gaming devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or gaming devices) are located. In certain embodiments in which the communication network includes a WAN, the gaming system includes a central server, central controller, or remote host and an EGM (or gaming device) each located in a different gaming establishment in a same geographic area, such as a same city or a same state. Gaming systems in which the communication network includes a WAN are substantially identical to gaming systems in which the communication network includes a LAN, though the quantity of EGMs (or gaming devices) in such gaming systems may vary relative to one another.

In further embodiments in which the gaming system includes: (a) an EGM (or gaming device) configured to communicate with a central server, central controller, or remote host through a data network; and/or (b) a plurality of EGMs (or gaming devices) configured to communicate with one another through a communication network, the communication network may include an internet (such as the Internet) or an intranet. In certain such embodiments, an Internet browser of the EGM (or gaming device) is usable to access an Internet game page from any location where an Internet connection is available. In one such embodiment, after the EGM (or gaming device) accesses the Internet game page, the central server, central controller, or remote host identifies a player before enabling that player to place any wagers on any plays of any wagering games. In one example, the central server, central controller, or remote host identifies the player by requiring a player account of the player to be logged into via an input of a unique player name and password combination assigned to the player. The central server, central controller, or remote host may, however, identify the player in any other suitable manner, such as by validating a player tracking identification number associated with the player; by reading a player tracking card or other smart card inserted into a card reader; by validating a unique player identification number associated with the player by the central server, central controller, or remote host; or by identifying the EGM (or gaming device), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or gaming device). Examples of implementations of Internet-based gaming are further described in U.S. Pat. No. 8,764,566, entitled "Internet Remote Game Server," and U.S. Pat. No. 8,147,334, entitled "Universal Game Server".

The central server, central controller, or remote host and the EGM (or gaming device) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or gaming devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

Embodiments of the present disclosure will be described in connection with a user interacting with one or more gaming devices. It should be appreciated that a gaming device, as described herein, may include a gaming machine, mobile devices, servers, and other computational devices. While embodiments of the present disclosure will be described in connection with the example of a slot machine, Electronic Gaming Machine (EGM), or Video Gaming Machine (VGM) facilitating an improved lottery game, it should be appreciated that embodiments of the present disclosure are not so limited. For instance, other types of computational devices, such as portable user devices, smartphones, tablets, laptops, Personal Computers (PCs), wearable devices, etc. may be configured with gaming device functionality (e.g., to implement a game of chance, a game or skill, or a hybrid game of chance/game of skill), similar to a gaming device as described herein. Furthermore, it should be appreciated that embodiments of the present disclosure may apply to gaming devices that operate games other than slot games and/or other than lottery games. For instance, embodiments of the present disclosure may be used in connection with any type of game of chance (e.g., bingo, keno, slots, video poker, table games, etc.), any type of game of skill (e.g., darts, memory games, matching games, strategy games, etc.), and/or any type of hybrid game of chance/skill.

In some embodiments, the positive attributes of a first game (e.g., a slot game) are combined with the positive attributes of a secondary game (e.g., a lottery game). As an example, the ability to win a game for the first game occurs multiple times within a period during which no opportunity to win the secondary game; however, the secondary game may be executed periodically and with inputs generated by machines executing the first game of chance.

In one example, Wide Area Network (WAN) or Local Area Networked (LAN)-linked slot games contribute to a lottery pool. In an example, a set of numbers (e.g., 5 Numbers) and an additional bonus ball or multiplier number are selected randomly and are displayed above banks of games to build anticipation toward the lottery jackpot. As a non-limiting example, any number of lottery numbers can be used for the set of numbers and/or additional multiplier number. A more specific, but non-limiting example, corresponds to a lottery game in which lottery numbers and a "Megaball" number are randomly selected. During game play of the slot machines, a normal game play scenario is possible. During game play, when a bonus is triggered, the user may enter a free spin event and try to collect as many of the "Megaball" numbers as they can during the free/bonus spins. As a non-limiting example, the pay table for the bonus game can be very much like a lottery pay table—if a user collects 2 numbers, they win 50 credits; 3 numbers, 100 credits; and so forth. The pay table numbers may remain static while the jackpot continues to grow in drawings of winning lottery numbers. At an instance of a lottery drawing when a jackpot is won, a reset event takes place and a new set of randomly selected numbers are displayed above the banks. For instance, when the jackpot is won there may be an interruption of all slot machine play or just a notification for those playing the WAN or LAN-linked slot games. Some similar win protocol to known lottery games can be applied at this instance. For example, all users wherever located will see a celebration on their screen. In some embodiments, an advertisement may be presented of where the win occurred geographically or at which part of the casino—as in lottery —, where the seeing where the winning ticket was purchased contributes to the fun surrounding the winning of a large prize. A celebratory "event"/drumroll and quick spin of the balls on the marquee and individual screens may determine the next set of winning numbers. In some embodiments, after the jackpot has been won for the lottery game, a prize meter may be reset and play resumes. If no jackpot was won at the instance of the lottery drawing, then the jackpot win value may continue to build, and users may continue participating in an attempt to win the growing jackpot at the next lottery drawing. This effectively represents one embodiment where a set of winning numbers are determined and then the users play toward collecting all of the winning numbers within a predetermined amount of time (e.g., before other users collect all of the winning numbers).

Where the lottery numbers are known beforehand (e.g., where one or more lottery numbers or the bonus number are predetermined prior to a user initiating game play and are presented to the user during game play for a predetermined amount of time and/or for a predetermined number of wager events/spins), the payout (or jackpot win) may depend upon the number of spins or wager events the user used to collect the predetermined winning numbers and/or bonus number. It is possible that if a user "hits" all of the winning lottery numbers on the very first bonus spin, the user may be entitled to the jackpot whereas if the user takes 10 or 100 bonus spins to collect the winning lottery numbers, then the user will receive some payout that is less than the jackpot and the jackpot may be allowed to continue building. It should be appreciated that the predetermined winning lottery numbers may be changed after a predetermined period of time has passed and/or after a player has attempted a predetermined number of spins or made a predetermined number of wager events.

Another embodiment is provided where the lottery numbers are not known beforehand. Rather, the user of the slot machine may play the slot machine and then enter into a bonus spin if some predetermined symbol combination occurs at the end of the spin. The triggering of the bonus spin may result in the slot machine switching into a mode where the slot machine generates lottery tickets or lottery balls/individual numbers for the user. The generation of a lottery ticket may correspond to a situation where the slot machine generates a complete lottery ticket (e.g., a ticket having a complete set of lottery numbers and a bonus lottery number preselected therefor). Alternatively, where the slot machine generates lottery balls/individual numbers for the user, the slot machine may be used to effectively build toward a complete lottery ticket for the user and continued game play by the user may enable the user to generate a complete lottery ticket or multiple lottery tickets with different sets of lottery numbers and/or bonus numbers assigned thereto. In some cases, as a result of achieving a predetermined symbol combination at the end of a bonus spin, the user may be assigned a complete lottery ticket whereas in other cases the user may be assigned a partial lottery ticket with less a complete set of lottery numbers assigned to the partial lottery ticket. As used herein, a ticket may include a physical lottery ticket with numbers printed thereon, an electronic ticket having numbers assigned thereto and stored in memory with association to a unique ticket identifier, or a combination of an electronic ticket and physical ticket. As the user continues playing in the bonus spin mode, the user may receive additional lottery balls or additional lottery tickets with ball numbers selected based on outcomes of reel spins, based on randomly-generated numbers, or a combination thereof. Each lottery ticket and the lottery numbers for the tickets generated or output at the slot machine may be communicated to a gaming server that tracks all of the lottery tickets distributed by various slot machines.

It should be appreciated that the first game (e.g., a slot game, a game of chance, game of skill, or hybrid game of chance/skill) may be administered, hosted, managed, or provided by a first entity whereas the secondary game (e.g., a lottery game) may be administered, hosted, managed, or provided by a second entity that is different from the first entity. The first entity may correspond to a public or private entity and the second entity may correspond to a public or private entity. For instance, the first game may be hosted by a first private entity (e.g., a casino operator) whereas the secondary game may be hosted by a second private entity (e.g., a charitable organization). As another example, the first game may be hosted by a private entity (e.g., a casino operator) and the secondary game may be hosted by a public entity (e.g., a state-run entity, a governmental entity, etc.). As another example, the first game may be hosted by a public entity (e.g., a state-run entity, a governmental entity, etc.) and the secondary game may be hosted by a different public entity (e.g., a state-run charitable organization). In some embodiments, there may be coordination between the first entity and the second entity even though both entities independently manage the first game and secondary game, respectively, meaning that rules to each of the first game and secondary game are determined by the independent entities, but rules for transitioning from the first game (e.g., based on outputs of the first game) to the secondary game (e.g., what inputs for the secondary game can be received from the first game) may be mutually agreed upon by the independent entities.

Users can hold onto physical tickets or have the tickets transferred to their mobile wallet on their mobile device or user account where they are securely stored until the drawing occurs. When the drawing occurs, the gaming server will know if a winning ticket was distributed and, if the winning ticket was distributed electronically, then the user associated with the winning ticket may be notified of their lottery win and informed that they need to return to the casino to collect their prize. These prizes can range from simple prizes (e.g., a free drink if the user had one winning lottery ball) all the way to a jackpot if the user's ticket matched all of the winning balls.

Either embodiment described above helps to build the hysteria that can surround a lottery drawing, especially where the jackpot has grown significantly, while also enabling users to enjoy the immediate satisfaction of playing and possibly winning a slot game. These and other features will be described in further detail herein.

In some embodiments, the first game may include a game of chance, the number or numbers generated as an output of the first game of may be generated with a random number generator, and the secondary game may also include a game of chance that utilizes a random number generator to determine an output.

In some embodiments, the secondary game may include a set of instructions that generate an electronic lottery ticket with at least the number assigned thereto as well as a set of instructions that assign the electronic lottery ticket to the user by storing an identification of the user in memory with an association to an identifier of the electronic lottery ticket. It may also be possible to cause a physical lottery ticket to be issued to the user by printing a physical ticket with the identifier thereon.

In some embodiments, a mobile device may be configured to execute one, some, or all of the games described herein. The mobile device may be provided with a set of instructions that enable communications with a gaming machine for purposes of participating in the first game and a set of instructions that enable communications with a gaming server for purposes of participating in the secondary game.

In some embodiments, the mobile device or a gaming device may be provided with a set of instructions that compare the number assigned to the user for the secondary game with a set of winning lottery numbers that are determined by a gaming server, where the set of instructions that compare the number assigned to the user for the secondary game with the set of winning lottery numbers determine a total number of lottery numbers assigned to the user, which is inclusive of the number, and further determine an award for the user from the secondary game based on how many numbers from the total number of lottery numbers match with the set of winning lottery numbers.

It should be appreciated that the award for the user may include a non-monetary award and/or a monetary award.

In some embodiments, the mobile device may be provided with a set of instructions that pair the mobile device with a gaming device for purposes of enabling the user to participate in the first game, where the mobile device is paired with the gaming device using a proximity-based communication protocol.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

With reference initially to FIG. 1, details of an illustrative gaming system 100 will be described in accordance with at least some embodiments of the present disclosure. The components of the gaming system 100, while depicted as having particular instruction sets and devices, is not necessarily limited to the examples depicted herein. Rather, a system according to embodiments of the present disclosure may include one, some, or all of the components depicted in the system 100 and does not necessarily have to include all of the components in a single device. For instance, the components of a gaming server 116 may be distributed among a plurality of servers, where one or more of the servers enable management of a first game of chance (e.g., slot games played at the plurality of gaming machines 112) and one or more other servers manage and execute a secondary game (e.g., a lottery game). The illustration of a single gaming server 116 is for ease of discussion and should not be construed as limiting embodiments of the present disclosure to a single-server architecture.

The gaming system 100 is shown to include a gaming network 104 and a communication network 108. The gaming network 104 may correspond to a distributed set of devices that interconnect and facilitate machine-to-machine communications between one or multiple gaming machines 112 and the gaming server 116. The communication network 108 may correspond to a distributed set of devices that interconnect and facilitate machine-to-machine communications between the gaming server 116 and mobile devices 128 carried by users 124. In some embodiments, the gaming network 104 and communication network 108 may correspond to different networks administered and/or maintained by different entities. In such a scenario, one or more of a gateway, firewall, or similar network border device may reside between the gaming network 104 and the communication network 108 (e.g., to maintain security preferences/settings of each network). In another possible scenario, the gaming network 104 and communication network 108 may correspond to the same or similar network. As a non-limiting example of the second scenario, the gaming network 104 and communication network 108 may both correspond to a distributed Internet Protocol (IP)-based communication network, such as the Internet.

A gaming network 104 and communication network 108 may include any type of known communication medium or collection of communication media and may use any type of protocols to transport messages between devices. As some non-limiting examples, the gaming network 104 may correspond to a WAN or LAN in which the plurality of gaming machines 112 are configured to communicate with the gaming server 116 using devices that are owned and administered by the same entity that administers security settings of the gaming machines 112. As such, the gaming network 104 may be considered a secure or trusted network.

The communication network 108, in some embodiments, may also include a WAN or LAN. Alternatively or additionally, the communication network 108 may include one or more devices that are not administered by the same entity administering the gaming machines 112. Thus, the communication network 108 may be considered an untrusted or unsecure network from the perspective of the gaming network 104. The Internet is an example of the communication network 104 that constitutes an IP network consisting of many computers, computing networks, and other communication devices located all over the world, which are connected through many telephone systems and other means. Other examples of the communication network 104 include, without limitation, a standard Plain Old Telephone System (POTS), an Integrated Services Digital Network (ISDN), the Public Switched Telephone Network (PSTN), a cellular network, and any other type of packet-switched or circuit-switched network known in the art. In some embodiments, the communication network 108 may be administered by a Mobile Network Operator (MNO) whereas a casino entity may administer the gaming network 104.

It should be appreciated that the gaming network 104 and/or communication network 108 need not be limited to any one network type, and instead may be comprised of a number of different networks and/or network types. Moreover, the gaming network 104 and/or communication network 108 may comprise a number of different communication media such as coaxial cable, copper cable/wire, fiber-optic cable, antennas for transmitting/receiving wireless messages, wireless access points, routers, and combinations thereof.

In some embodiments, the gaming machines 112 may be distributed throughout a single property or premises (e.g., a single casino floor) or the gaming machines 112 may be distributed among a plurality of different properties. In a situation where the gaming machines 112 are distributed in a single property or premises, the gaming network 104 may include at least some wired connections between network nodes (e.g., a LAN or multiple LANs). As a non-limiting example, the nodes of the gaming network 104 may communicate with one another using any type of known or yet-to-be developed communication technology. Examples of such technologies include, without limitation, Ethernet, SCSI, PCIe, RS-232, RS-485, USB, ZigBee, WiFi, CDMA, GSM, HTTP, TCP/IP, UDP, etc.

The gaming machines 112 may utilize the same or different types of communication protocols to connect with the gaming network 104. It should also be appreciated that the gaming machines 112 may or may not present the same type of game to a user 124. For instance, the first gaming machine 112 may correspond to a gaming machine that presents a slot game to the user 124 whereas a second gaming machine 112 may correspond to a gaming machine that presents a different type of slot game or a video poker game to a user 124. It should be appreciated that a gaming machine 112 may correspond to one example of a gaming device. It should also be appreciated that the functions and features described in connection with a gaming machine 112 may be provided in any other type of gaming device without departing from the scope of the present disclosure.

In some embodiments, the gaming machines 112 may be configured to communicate with a centralized management server in the form of the gaming server 116. The gaming server 116 may be configured to centrally manage games of chance, games of skill, or hybrid games of chance/skill played at the gaming machines 112 (e.g., slot games), enable execution of a different game (e.g., a lottery game), monitor user 124 activity at the gaming machines 112, track user 124 association with a gaming machine 112, facilitate communications with users 124 via the gaming machines 112, facilitate communications with users 124 via the mobile devices 128 (or other gaming devices), and/or perform any other task in connection with games played by a user 124 at gaming devices.

In some embodiments, a user 124 may be enabled to enhance their experience with the gaming machines 112 via interactions with their personal mobile device 128. In some embodiments, a mobile device 128 may be configured to execute one or more games of chance, one or more games of skill, and/or one or more hybrid games of chance/skill that are also executable by a gamine machine 112. Thus, in some embodiments, a mobile device 128 may be considered another example of a gaming device. In some embodiments, the mobile device 128 may be referred to as a personal gaming device that is configured to be owned and carried by a user 124. For instance, a user 124 may be allowed to play a first game (e.g., a slot game) at their mobile device 128, play a secondary game (e.g., a lottery game) at their mobile device 128, or engage with both the first game of chance and secondary game at their mobile device 128 without ever having to physically engage a gaming machine 112. The mobile device 128 may correspond to a mobile communication device, such as a smartphone, tablet, laptop, PDA, wearable device, an augmented reality headset, a virtual reality headset, or the like. In other embodiments, the mobile device 128 may correspond to a PC, kiosk, or the like that facilitates improved lottery game play for the user 124. Any of the above-mentioned examples of a mobile device 128 may correspond to an example of a gaming device as described herein.

In some embodiments, a mobile device 128 may be configured to communicate directly with a gaming machine 112. In some embodiments, some or all of the game play may be achieved with the mobile device 128 rather than relying on the use of a gaming machine 112. Where a mobile device 128 interacts with a gaming machine 112, direct machine-to-machine communications may utilize a proximity-based communication protocol such as NFC, Bluetooth®, BLE, WiFi, or the like. Alternatively or additionally, the mobile devices 128 may be configured to communicate with other mobile devices 128 and/or the gaming server 116 via the communication network 108. Such communications may be secured (e.g., encrypted) or unsecured depending upon the nature of information exchanged during the communications. A mobile device 128 may correspond to a user's 124 personal device that uses an unsecured or untrusted communication network 108 or to a device issued to the user 124 during the user's visit at a particular casino, in which case the mobile device 128 may be administered with certain casino-approved security policies.

It should be appreciated that the gaming server 116 may or may not be co-located with the gaming machines 112. Further still, users 124 may be allowed to carry multiple mobile devices 128, which may or may not be required to communicate or pair with a gaming machine 112.

FIG. 1 also depicts the possibility of some mobile devices 128 being paired with a gaming machine 112, thereby enabling communications to flow between the mobile device 128 and gaming machine 112. This communication may utilize a proximity-based communication protocol, such as Bluetooth, BLE, NFC, WiFi, etc. FIG. 1 further shows that one or more mobile devices 128 may not necessarily be paired with a gaming machine 112, but such mobile devices 128 may still be configured to communicate with the gaming server 116 via the communication network 108. Communications between the gaming machine 112 and mobile device 128 may facilitate any number of combinations of gameplay opportunities. For instance, a user 124 may play a first game on a gaming machine 112 and play a secondary game (based on outcomes of the first game) on their mobile device 128. As another example, a user 124 may play a first game on their mobile device 128 and then play a second game (based on outcomes of the first game) on the gaming machine 112.

Figure 2:
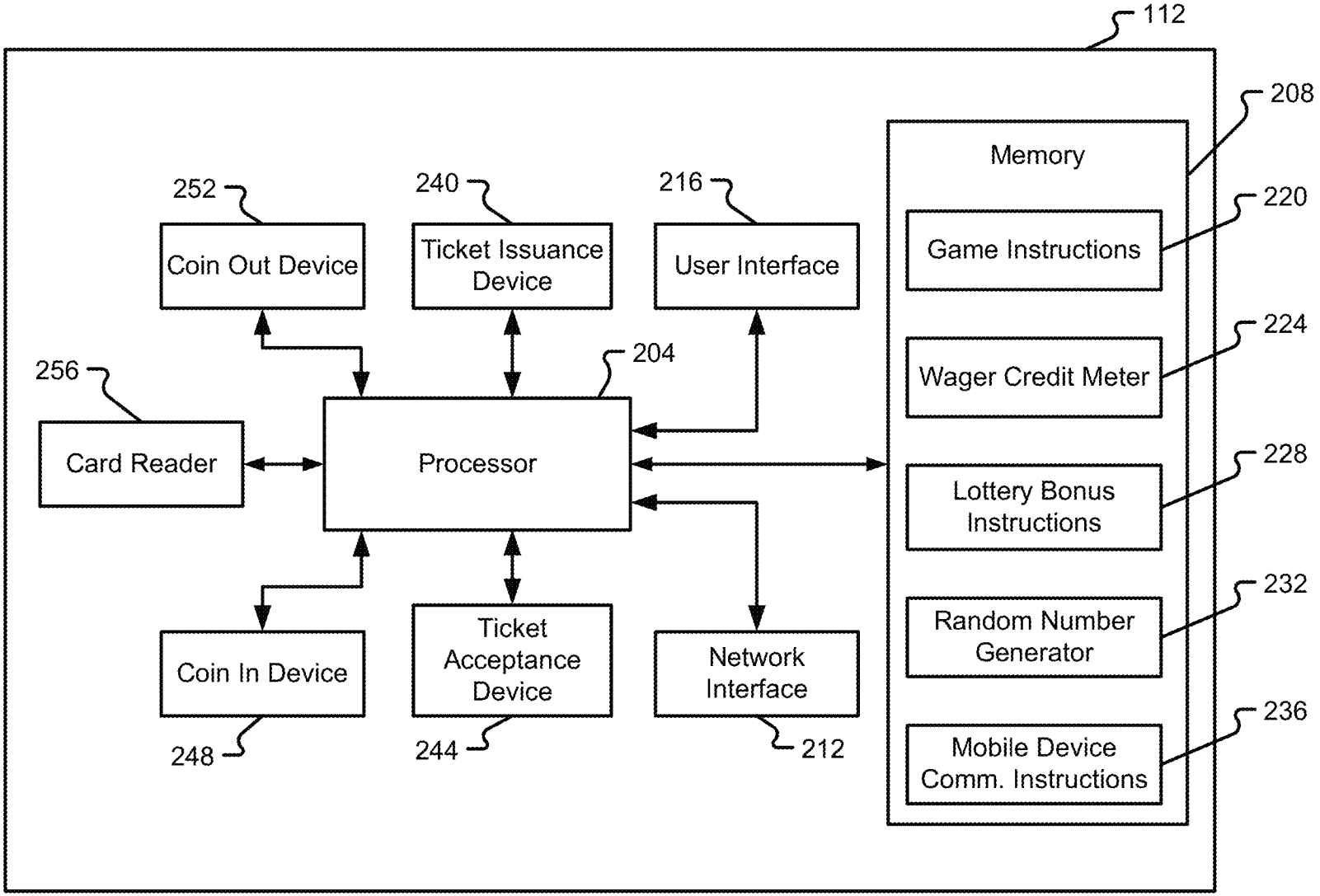
FIG. 2 illustrates a gaming machine in accordance with embodiments of the present disclosure.

With reference now to FIG. 2, additional details of the components that may be included in a gaming machine 112 or any other gaming device will be described in accordance with at least some embodiments of the present disclosure.

A gaming machine 112 may correspond to a portable or non-portable device used for executing a gaming application or multiple different gaming applications without departing from the scope of the present disclosure. Non-limiting examples of a gaming machine 112 include an EGM, a VGM, a mobile communication device (e.g., a smartphone, laptop, wearable device, etc.), a laptop, a PC, etc. The illustrative gaming machine 112 depicted herein may include a support structure, housing or cabinet, which provides support for a plurality of displays, inputs, controls and other features of a conventional gaming machine. In some embodiments, a user 124 plays gaming machine 112 while sitting, however, the gaming machine 112 is alternatively configured so that a user can operate it while standing or sitting. The illustrated gaming machine 112 can be positioned on the floor but can be positioned alternatively (i) on a base or stand, (ii) as a pub-style table-top game (e.g., where the participant computational devices are located remotely from the shared wheel as discussed below), (iii) as a stand-alone computational device on the floor of a casino with other stand-alone computational devices, or (iv) in any other suitable manner. The gaming machine 112 can be constructed with varying cabinet and display configurations.

The gaming machine 112 is shown to include a processor 204, memory 208, a network interface 212, and a user interface 216. In some embodiments, the processor 204 may correspond to one or many microprocessors, CPUs, microcontrollers, Integrated Circuit (IC) chips, or the like. The processor 204 may be configured to execute one or more instruction sets stored in memory 208. In some embodiments, the instruction sets stored in memory 208, when executed by the processor 204, may enable the gaming machine 112 to provide game play functionality.

The nature of the network interface 212 may depend upon whether the network interface 212 is provided in cabinet-style gaming machine 112 or a mobile gaming machine 112. Examples of a suitable network interface 212 include, without limitation, an Ethernet port, a USB port, an RS-232 port, an RS-485 port, a NIC, an antenna, a driver circuit, a modulator/demodulator, etc. The network interface 212 may include one or multiple different network interfaces depending upon whether the gaming machine 112 is connecting to a single gaming network 104 or multiple different types of gaming networks 104. For instance, the gaming machine 112 may be provided with both a wired network interface 212 and a wireless network interface 212 without departing from the scope of the present disclosure.

The user interface 216 may include a combination of user input devices and user output devices. For instance, the user interface 216 may include a display screen, speakers, buttons, levers, a touch-sensitive display, or any other device that is capable of enabling user 124 interaction with the gaming machine 112. The user interface 216 may also include one or more drivers for the various hardware components that enable user 124 interaction with the gaming machine 112.

The memory 208 may include one or multiple computer memory devices that are volatile or non-volatile. The memory 208 may be configured to store instruction sets that enable user interaction with the gaming machine 112 and that enable game play at the gaming machine 112. Examples of instruction sets that may be stored in the memory 208 include a game instruction set 220, a credit meter 224, and a lottery bonus instruction set 228. In addition to the instruction sets, the memory 208 may also be configured to store a random number generator 232 that is used by the game instruction set 220 and/or lottery bonus instruction set 228, for example, to provide game outputs. The gaming machine 112 is also shown to include a mobile device communication instruction set 236 that may enable the gaming machine 112 to exchange electronic communications with a mobile device 128, either directly or indirectly.

In some embodiments, the game instruction set 220, when executed by the processor 204, may enable the gaming machine 112 to facilitate one or more games of chance or skill and produce interactions between the user and a first game of chance. In some embodiments, the game instruction set 220 may include subroutines that present one or more graphics to the user via the user interface 216, subroutines that calculate whether a particular wager has resulted in a win or loss during the game of chance or skill, subroutines for determining payouts for the user in the event of a win during the first game of chance, subroutines for exchanging communications with another device, such as server 116, subroutines for determining bonus spin opportunities during game play, and any other subroutine useful in connection with facilitating game play at the gaming machine 112. In some embodiments, the game instruction set 220 may be configured to determine when a user 124 has qualified for a bonus spin opportunity or otherwise can transition from a first game of chance to a secondary game. As an example, the game instruction set 220 may be configured to call the lottery bonus instruction set 228 when a predetermined symbol combination lands on a pay line at the end of a spin, when a predetermined symbol lands on a pay line at the end of a spin, etc.

In some embodiments, the game instruction set 220 may include instructions that initiate a reel spin at the various reels in connection with game play. In some embodiments, the random number generator 232 is used to determine a final position of the reels after the spin is completed. The game instruction set 220 may also be configured to present symbols via a display screen when the reels correspond to video reels or the like. The game instruction set 220 may also be configured to evaluate a position of symbols relative to one or more pay lines, relative to predetermined symbol areas, and any other evaluation desired to facilitate game play.

The credit meter 224 may correspond to an instruction set within the gaming machine 112 that facilitates a tracking of wager activity at the gaming machine 112. In some embodiments, the credit meter 224 may be used to store or log information related to various user activities and events that occur at the gaming machine 112. The types of information that may be maintained in the credit meter 224 include, without limitation, user information, available credit information, wager amount information, and other types of information that may or may not need to be recorded for purposes of accounting for wagers placed at the gaming machine 112 and payouts made for a user during a first game of chance played at the gaming machine 112.

In some embodiments, the credit meter 224 may be configured to track coin in activity, coin out activity, coin drop activity, jackpot paid activity, credits applied activity, external bonus payout activity, voucher in activity, voucher out activity, timing of events that occur at the gaming machine 112, and the like. In some embodiments, certain portions of the credit meter 224 may be updated in response to outcomes of a first game of chance played at the gaming machine 112. Alternatively or additionally, the credit meter 224 may also be configured to account for wagers placed in connection with a secondary game (e.g., a lottery game), account for outcomes of the secondary game (e.g., lottery wins), etc.

The lottery bonus instruction set 228, when executed by the processor 204, may enable user 124 interaction with a secondary game that is being administered by the server 116. In some embodiments, the lottery bonus instruction set 228 may also be configured to assign lottery numbers to a user 124, determine when a user 124 is eligible to redeem or try to earn a lottery number at the gaming machine 112, execute a bonus spin opportunity in which lottery numbers are earned by a user 124, update electronic records reflecting lottery numbers assigned to a user 124, report lottery numbers assigned to a player 124 back to the gaming server 116, and perform any other function useful to administer a lottery game with the gaming machine 112.

The mobile device communication instruction set 236, when executed by the processor 204, may enable the gaming machine 112 to communicate with the mobile device 128 or multiple mobile devices 128. In some embodiments, the mobile device communication instruction set 236 may include instructions that enable the gaming machine 112 to pair with a mobile device 128 and establish a communication channel with the mobile device 128 via the pairing. As an example, the mobile device communication instruction set 236 may include instructions that enable NFC, Bluetooth®, WiFi, or other types of communication protocols. It should be appreciated that the mobile device communication instruction set 236 may also be updated to reflect when a mobile device 128 is paired with the gaming machine 112 and such pairing information may include addressing information for the mobile device 128 and/or identification information associated with the user 124 of the mobile device 128. Alternatively or additionally, the mobile device communication instructions 236 may enable the gaming machine 112 to identify a user 124 of the mobile device 128, identify a loyalty account associated with the user 124 of the mobile device 128, exchange information (e.g., send or receive) with a loyalty application operating on the mobile device 128, or combinations thereof. In some embodiments, the mobile device communication instructions 236 may be configured to operate or drive the network interface 212 to facilitate direct or indirect communications with a mobile device 128.

While shown as separate instruction sets, it should be appreciated that the lottery bonus instruction set 228 may correspond to a subroutine of the game instruction set 220 without departing from the scope of the present disclosure.

The gaming machine 112 is further shown to include a ticket issuance device 240, a ticket acceptance device 244, a coin in device 248, a coin out device 252, and a card reader 256. The ticket issuance device 240 may be configured to print physical tickets, vouchers, or the like. The ticket acceptance device 244 may be configured to receive, scan, and/or recognize information from an input physical ticket, voucher, or cash. In some embodiments, the ticket issuance device 240 and ticket acceptance device 244 may operate in concert with a common piece of hardware that both accepts and produces physical tickets, vouchers, or the like. Tickets or vouchers printed by ticket issuance device 240 and recognizable by the ticket acceptance device 244 may correspond to physical lottery tickets, casino vouchers, paper coupons, and the like. Alternatively or additionally, the ticket issuance device 240 and/or ticket acceptance device 244 may be connected to ticket or cash reading hardware. In such an embodiment, the ticket issuance device 240 and ticket acceptance device 244 may operate as a driver and/or firmware component for the card reader.

Similarly, the coin in device 248 and coin out device 252 may include or operate in concert with a coin slot or any other type of coin delivery mechanism. The coin in device 248 and coin out device 252 may include hardware, drivers, or firmware that facilitate receiving or distributing tokens, coins, chips, etc. In some embodiments, the coin in device 248 may be configured to determine an amount of coins (an amount of tokens, an amount of chips, etc., input at the coin slot and convert the values into credits for playing games with the game instruction set 220. The coin out device 252 may correspond to hardware and software configured to output coins, tokens, chips, etc. if a user decides to cash out or convert playing credits back into coins, tokens, or chips, etc.

The card reader 256 may include hardware and/or software configured to read or accept any type of card or portable credential. In some embodiments, the card reader 156 may include hardware and/or software that enable contactless reading of a card or portable credential (e.g., NFC, Bluetooth, Wifi, etc.). In some embodiments, the card reader 156 may include hardware and/or software that enable contact-based reading of a card or portable credential (e.g., magstripe, chip reader, electrodes, card-receiving slot, etc.). It should be appreciated that the card reader 156 may be configured to receive and reader a card or portable credential in any type of format (e.g., portable plastic card, magstripe card, key fob, etc.). It should also be appreciated that the card reader 156 may be configured to write information or data onto a card or portable credential. Furthermore, in some embodiments, the card reader 156 may be configured to read a player loyalty card in the form of a plastic credit-card shaped credential. In some embodiments, the card reader 156 may be enable communications with a loyalty application operating on a user's mobile device 128.

Figure 3:
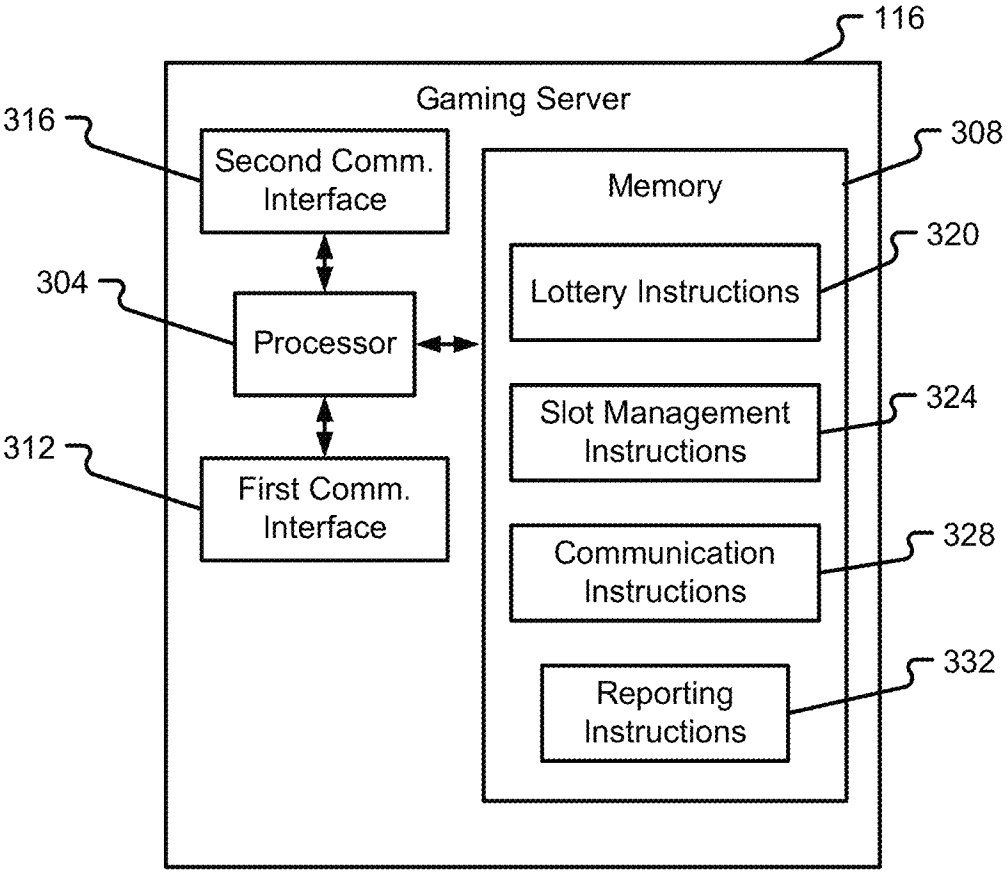
FIG. 3 illustrates a gaming server in accordance with embodiments of the present disclosure.

With reference now to FIG. 3, additional details of a gaming server 116 will be described in accordance with embodiments of the present disclosure. The gaming server 116 is shown to include a processor 304, memory 308, and a plurality of communication interfaces 312, 316. These resources may enable functionality of the gaming server 116 as will be described herein. For instance, the first communication interface 312 may provide the gaming server 116 with the ability to send and receive communication packets or the like over the gaming network 104. The first communication interface 312 may be provided as a network interface card (NIC), a network port, drivers for the same, and the like. Communications between the components of the gaming server 116 and other devices connected to the gaming network 104 may all flow through the first communication interface 312.

The gaming server 116 is also shown to include a second communication interface 316 that facilitates communications with the mobile devices 128 via the communication network 108. In some embodiments, the second communication interface 316 may be similar to the first communication interface 312. For instance, the second communication interface 316 may also include a NIC, network port, drivers for the same, and the like. In some embodiments, the first and second communication interfaces 312, 316 may be provided in a single physical component or set of components, but may correspond to different communication channels (e.g., software-defined channels, frequency-defined channels, amplitude-defined channels, etc.) that are used to send/receive different communications to the mobile devices 128 as compared to the gaming machines 112. In some embodiments, a single communication interface may facilitate communications with both the gaming machines 112 and mobile devices 128, especially if both devices communicate with the gaming server 116 via a common network.

The processor 304 may be similar or identical to the processor 204 and may correspond to one or many computer processing devices. For instance, the processor 304 may be provided as silicon, as a Field Programmable Gate Array (FPGA), an Application-Specific Integrated Circuit (ASIC), any other type of Integrated Circuit (IC) chip, a collection of IC chips, or the like. As a more specific example, the processor 304 may be provided as a microcontroller, microprocessor, Central Processing Unit (CPU), or plurality of microprocessors that are configured to execute the instructions sets stored in memory 308. Upon executing the instruction sets stored in memory 308, the processor 304 enables various authentication functions of the gaming server 116.

The memory 308 may be similar or identical to memory 208 and may include any type of computer memory device or collection of computer memory devices. The memory 308 may include volatile and/or non-volatile memory devices. Non-limiting examples of memory 308 include Random Access Memory (RAM), Read Only Memory (ROM), flash memory, Electronically-Erasable Programmable ROM (EEPROM), Dynamic RAM (DRAM), etc. The memory 308 may be configured to store the instruction sets depicted in addition to temporarily storing data for the processor 304 to execute various types of routines or functions.

The illustrative instruction sets that may be stored in memory 308 include, without limitation, a lottery instruction set 320, a slot management instruction set 324, a communication instruction set 328, and a reporting instruction set 332. Functions of the gaming server 116 enabled by these various instruction sets will be described in further detail herein. It should be appreciated that the instruction sets depicted in FIG. 3 may be combined (partially or completely) with other instruction sets or may be further separated into additional and different instruction sets, depending upon configuration preferences for the gaming server 116. Said another way, the particular instruction sets depicted in FIG. 3 should not be construed as limiting embodiments described herein.

In some embodiments, the lottery instruction set 320, when executed by the processor 304, may enable the gaming server 116 to execute a lottery game or multiple lottery games as described herein. In some embodiments, the lottery instruction set 320 corresponds to a specific but non-limiting example of instructions that enable a user 124 to engage in a first game at a gaming device. In some embodiments, the lottery instruction set 320 may cooperate with the lottery bonus instruction set 228 of the gaming machines 112 to facilitate user 124 interactions with a lottery game or other type of first game (e.g., game of chance, game of skill, or hybrid game of chance/skill). In some embodiments, the lottery instruction set 320 may also be configured to coordinate with the gaming machines 112 to determine which lottery numbers have been assigned to or won by a user 124. In some embodiments, the lottery instruction set 320 may be configured to randomly draw winning lottery numbers (e.g., using a random number generator which causes a predefined number of lottery numbers to be selected from a larger fixed set of possible lottery numbers) from time to time or a periodic basis. The lottery instruction set 320 may also be configured to compare winning lottery numbers with numbers assigned to users 124 to determine if a particular user 124 has been assigned some or all of the winning/recently-drawn lottery numbers. The lottery instruction set 320 may also be configured to determine a way of communicating with winning users 124 about their winning lottery numbers.

The slot management instruction set 324, when executed by the processor 304, may enable the gaming server 116 to manage operations of and communications with the gaming machines 112. In some embodiments, the slot management instruction set 324 may be configured to manage various aspects of slot games played at the gaming machines 112 as well as manage communications with users 124 that are playing the gaming machines 112. In some embodiments, the slot management instruction set 324 corresponds to a specific but non-limiting example of instructions that enable a user 124 to engage in a secondary game at a gaming device. In some embodiments, the slot management instruction set 324 may be configured to manage a progressive slot game in which a plurality of slot games played at the plurality of slot machines 112 are attempting to win a progressive jackpot prize. In some embodiments, the progressive jackpot prize may correspond to a prize that also requires cooperation with the lottery instruction set 320 (e.g., because winning the progressive jackpot prize includes a condition to win the lottery game executed by the lottery instruction set 320).

The communication instruction set 328, when executed by the processor 304, may enable the gaming server 116 to communicate with the other devices in the system 100. For instance, the communication instruction set 328 may be configured to modulate/demodulate communications exchanged over the gaming network 104 and/or communication network 108, determine timings associated with such communications, determine addresses associated with such communications, etc. In some embodiments, the communication instruction set 328 may be configured to allocate communication ports of the gaming server 116 for use as either the first or second communication interface 312, 316 as appropriate. The communication instruction set 328 may further be configured to generate messages in accordance with communication protocols used by the networks 104, 108 and to parse messages received via the networks 104, 108.

The reporting instruction set 332, when executed by the processor 304, may enable the gaming server 116 to generate and send reports to other communication devices (e.g., gaming machines 112, mobile devices 128, other servers, etc.). The reports generated by the reporting instruction set 332 may include information describing outcomes of slot games, outcomes of lottery games, outcomes at particular gaming machines, outcomes associated with a particular user 124, outcomes associated with a group of users 124, etc. In some embodiments, the reporting instruction set 332 may also be configured to determine a destination address for a report or for information from a report. For example, the reporting instruction set 332 may be configured to identify a destination address for a communication regarding an outcome of a lottery game and then transmit relevant information to the destination address, which may correspond to an IP address, MAC address, user identity, etc. As such, the reporting instruction set 32 may be configured to transmit information to particular users 124 regarding their outcomes for a lottery game directly to the user's 124 mobile device 128.

Figure 4:
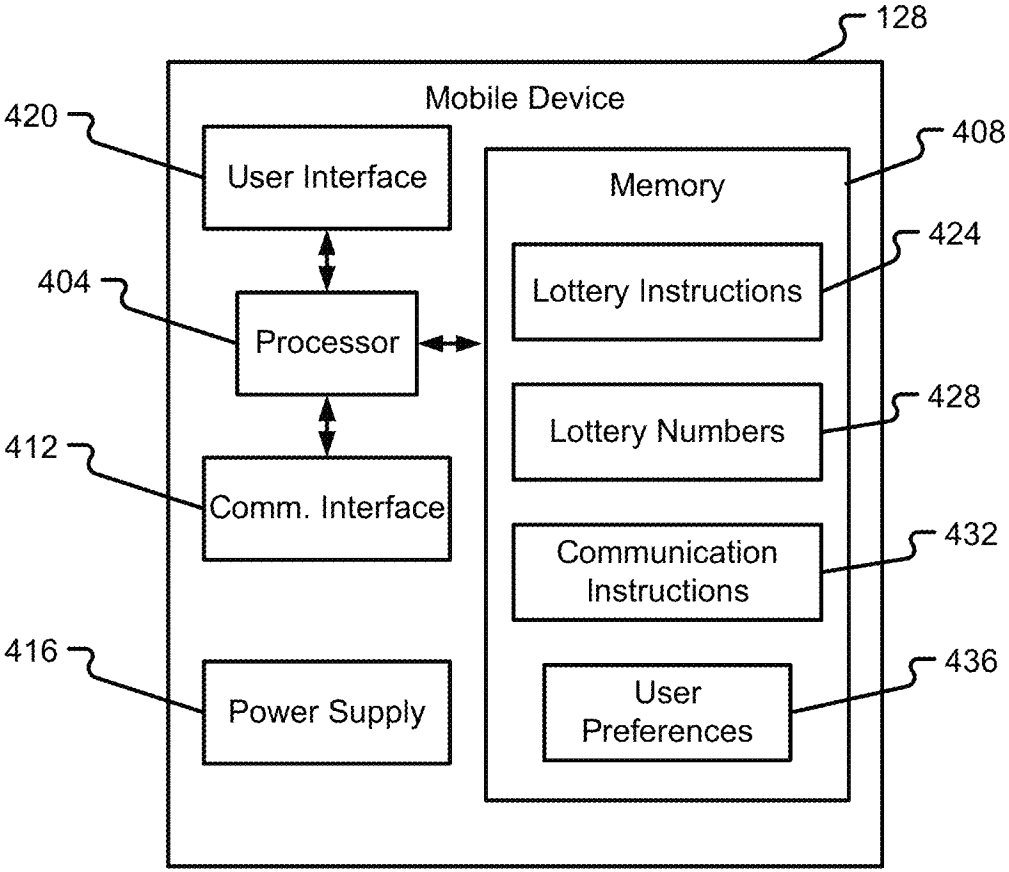
FIG. 4 illustrates a mobile device in accordance with embodiments of the present disclosure.

With reference now to FIG. 4, additional details of the components that may be included in a mobile device 128 will be described in accordance with at least some embodiments of the present disclosure. The mobile device 128 is shown to include a processor 404, memory 408, a communication interface 412, and a user interface 420. In some embodiments, the processor 404 may be similar or identical to any of the other processors 204, 304 depicted and described herein and may correspond to one or many microprocessors, CPUs, microcontrollers, Integrated Circuit (IC) chips, or the like. The processor 404 may be configured to execute one or more instruction sets stored in memory 408. In some embodiments, the instruction sets stored in memory 408, when executed by the processor 404, may enable the mobile device 128 to provide game play functionality, interact with gaming machines 112, pair with gaming machines 112, or any other type of desired functionality.

The communication interface 412 may be similar or identical to the network interface 212 and/or communication interfaces 312, 316 depicted and described herein. The nature of the communication interface 412 may depend upon the type of communication network 108 for which the mobile device 128 is configured. Examples of a suitable communication interfaces 412 include, without limitation, a WiFi antenna and driver circuit, a Bluetooth antenna and driver circuit, a cellular communication antenna and driver circuit, a modulator/demodulator, etc. The communication interface 412 may include one or multiple different network interfaces depending upon whether the mobile device 128 is connecting to a single communication network 108 or multiple different types of communication networks. For instance, the mobile device 128 may be provided with both a wired communication interface 412 and a wireless communication interface 412 without departing from the scope of the present disclosure.

The user interface 420 may include a combination of a user input and user output device. For instance, the user interface 420 may include a display device, a microphone, a speaker, a haptic feedback device, a light, a touch-sensitive display, a button, or a combination thereof. The user interface 420 may also include one or more drivers for the various hardware components that enable user interaction with the mobile device 128.

The memory 408 may be similar or identical to other memory 208, 308 depicted and described herein and may include one or multiple computer memory devices that are volatile or non-volatile. The memory 408 may be configured to store instruction sets that enable player interaction with the mobile device 128 and that enable game play at the mobile device 128. Examples of instruction sets that may be stored in the memory 408 include a lottery instruction set 424 and a communication instruction set 432. In addition to the instruction sets, the memory 408 may also be configured to store data that is useable by the various instruction sets. Examples of such data that may be stored in memory 408 include, without limitation, lottery numbers 428 and user preferences 436.

In some embodiments, the lottery instruction set 424, when executed by the processor 404, may enable the mobile device 128 to facilitate one or more games of chance or skill and produce interactions between the player and the game of chance or skill. In some embodiments, the lottery instruction set 424 may include subroutines that present one or more graphics to the user 124 via the user interface 420, subroutines that calculate whether a particular wager has resulted in a win or loss during the game of chance or skill, subroutines for determining payouts for the player in the event of a win, subroutines for exchanging communications with another device, such as the gaming server 116 and/or gaming machine 112, subroutines for determining lottery bonus spin opportunities during game play, and any other subroutine useful in connection with facilitating game play at the mobile device 128 and/or gaming machine 112. In some embodiments, the lottery instruction set 424 is configured to cooperate with the lottery bonus instruction set 228 and/or lottery instruction set 320. In some embodiments, the lottery instruction set 424 may enable the mobile device 128 to communicate with a gaming machine 112 and determine which lottery numbers have been assigned to/won by the user 124 of the gaming machine 112 and mobile device 128 during a lottery game or other type of first game (e.g., during execution of the lottery bonus instruction set 228). The lottery instruction set 424 may be configured to receive the indication of lottery numbers assigned to the user 124 and store those numbers as lottery numbers 428. Lottery numbers 428 may be maintained in memory until a next occurrence of a lottery drawing at which point the lottery numbers 428 may be compared by the lottery instruction set 320 with winning/drawn lottery numbers. Because the lottery numbers 428 are also stored in local memory 408 of the mobile device 128, the user 124 can check his/her assigned lottery numbers at will and regardless of whether or not the mobile device 128 is connected to the communication network 108. As will be described in further detail herein, the lottery numbers 428 may be cleared from memory 408 or be marked with a particular timestamp indicating when the lottery numbers 428 were assigned, thereby ensuring that only currently-assigned lottery numbers 428 are compared with winning lottery numbers at a given instance of a lottery drawing.

The communication instruction set 432, when executed by the processor 404, may enable the mobile device 128 to communicate via the communication network 108. In some embodiments, the communication instruction set 432 may be similar or identical to the communication instruction set 328 and may be particular to the type of communication network 108 used by the mobile device 128. As an example, the communication instruction set 432 may be configured to enable cellular, WiFi, and/or Bluetooth communications with other devices. The communication instruction set 432 may follow predefined communication protocols and, in some embodiments, may enable the mobile device 128 to remain paired with a gaming machine 112 as long as the mobile device 128 is within a predetermined proximity (e.g., 20-30 feet, an NFC communication range, or a Bluetooth communication range) and paired with the gaming machine 112.

The user preferences 436 may correspond to gaming or wager preferences that are desired by the user 124 of the mobile device 128. In some embodiments, where the mobile device 128 is not owned by the user 124, but rather is loaned to the user 124 by a casino operator, the user preferences 436 may include default preferences defined by the casino as well as other preferences that are defined by the user 124 after receiving the mobile device 128. The user preferences 436 may alternatively or additionally relate to communication preferences that drive operation of the communication instruction set 432. In some embodiments, the user preferences 436 may include game play preferences that are referenced by the lottery instructions 424 and that may enable automated selection or assignment of lottery numbers if lottery numbers are earned by the user 124 while playing a lottery game at a gaming machine 112. For instance, the user 124 may be allowed to define (before playing a slot game at the gaming machine 112) one or more lottery numbers that are desired if the user 124 begins a lottery bonus game at the gaming machine 112. The gaming machine 112 and mobile device 128 may be configured to communication with one another and, in some embodiments, the mobile device 128 may provide some or all of the user preferences 436 to the gaming machine 112 for use during a game play session or at least until the user 124 leaves the gaming machine 112 (e.g., as determined by the mobile device 128 leaving the predetermined proximity of the gaming machine 112).

The mobile device 416 is also shown to include a power supply 416. The power supply 416 may correspond to an internal power supply that provides AC and/or DC power to components of the mobile device 128. In some embodiments, the power supply 416 may correspond to one or multiple batteries. Alternatively or additionally, the power supply 416 may include a power adapter that converts AC power into DC power for direct application to components of the mobile device 128, for charging a battery, for charging a capacitor, or a combination thereof.

Figure 5:
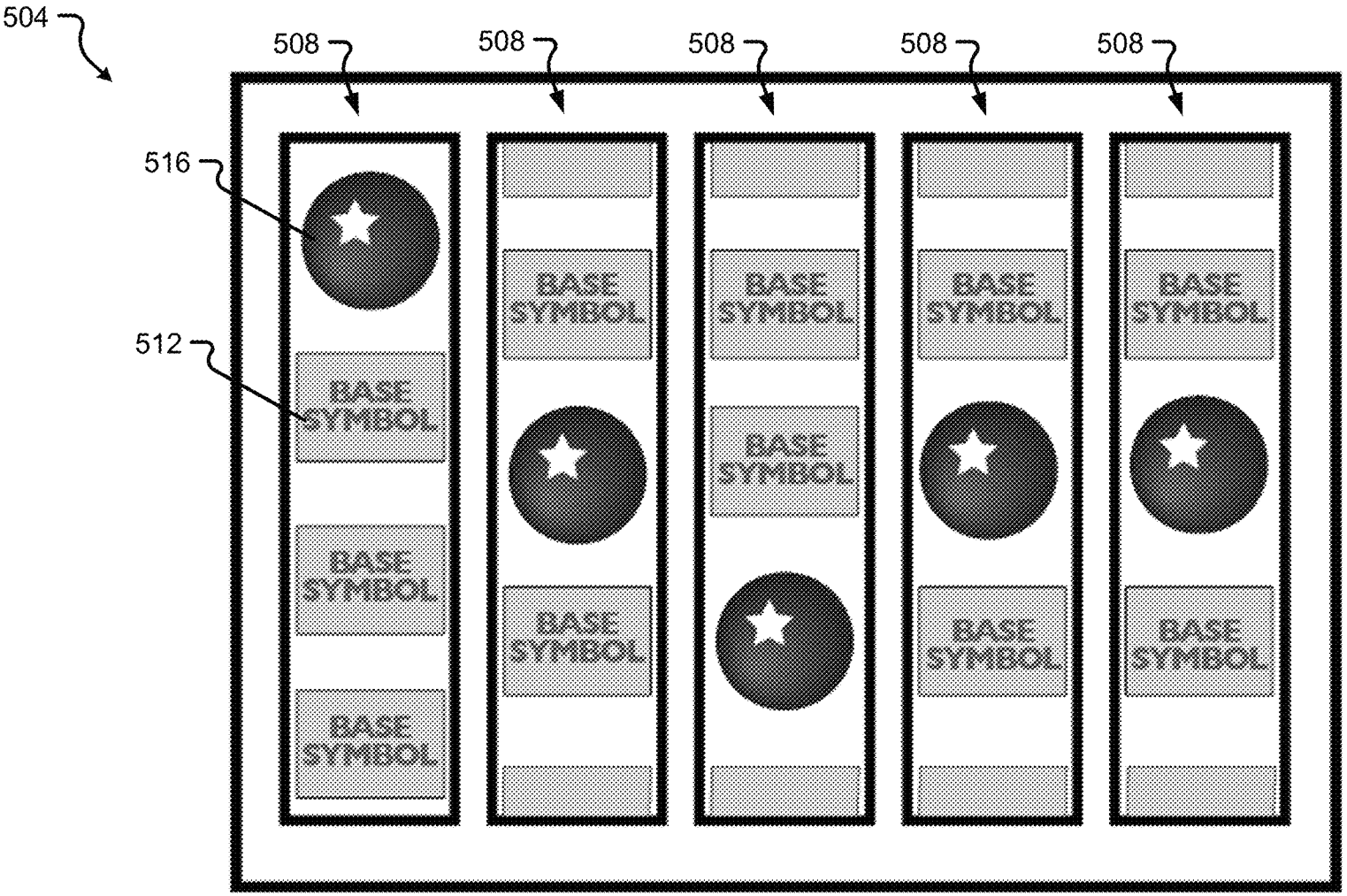
FIG. 5 illustrates a display of a gaming device in a first configuration in accordance with embodiments of the present disclosure.
Figure 6:
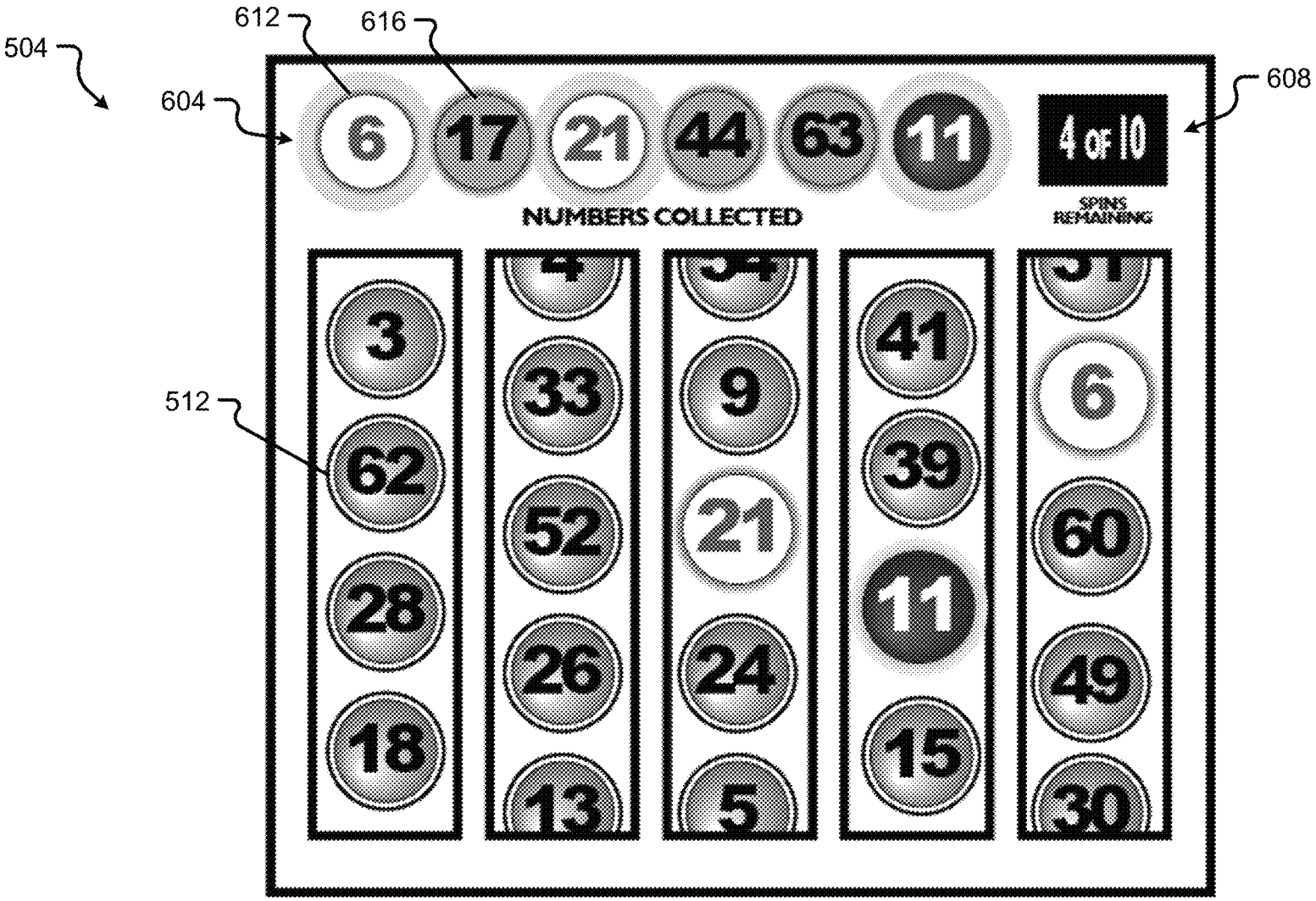
FIG. 6 illustrates a display of a gaming device in a second configuration in accordance with embodiments of the present disclosure.

With reference now to FIGS. 5-10, various operations of a gaming machine 112, gaming server 116, and/or mobile device 128 will be described in accordance with at least some embodiments of the present disclosure. Referring initially to FIGS. 5 and 6, a user interface presented by a gaming device (e.g., gaming machine 112 and/or mobile device 128) during game play of a first game (e.g., a slot game) will be described in accordance with embodiments of the present disclosure. The particular user interface depicted in FIGS. 5 and 6 should not be construed as limiting embodiments of the present disclosure to a particular type of game of chance, but rather is provided for illustrative and discussion purposes.

In some embodiments, an array of symbol areas 504 is presented by a display screen (e.g., an example of a user interface 216) of the gaming device. In some embodiments, the array of symbol areas 504 may be presented by a user interface 420 of a mobile device 128 if the user 124 is playing the first game on their mobile device 128 and/or if the mobile device 128 is paired with a gaming machine 112 for purposes of playing the first game. In some embodiments, the game instruction set 220, lottery bonus instruction set 228, lottery instruction set 320, and/or lottery instruction set 424 may control which particular symbols 512, 516 are presented within a particular symbol area. The illustrative array of symbol areas 504 is shown to include five columns 508, where each column 508 includes a plurality of symbol areas (e.g., corresponding to rows). Although FIG. 5 illustrates a 5×N array of symbol areas 504, it should be appreciated that embodiments of the present disclosure can be implemented in an array of symbol areas 504 having a variety of sizes. For instance, embodiments of the present disclosure may be used in an array of symbol areas 504 that are 3×3, 3×5, 5×3, 7×3, 10×5, 10×10, etc. The example layout of the array of symbol areas 504 should not be construed as limiting embodiments of the present disclosure.

As can be seen in FIG. 5, each symbol area in the array of symbol areas 504 may be populated with a single symbol such as a base symbol 512 or a bonus symbol 516. In other words, after the game instruction set 220 has applied a random number generator 232 to determine symbol 512, 516 placement throughout the array of symbol areas 504, there will be a 1:1 correlation of symbols to symbol areas. Each column 508 may also be referred to as a reel, particularly in the event that the game instruction set 220 provides a slot game. If a slot game is implemented, then the reels (mechanical or video) are spun (physically or virtually) and their final position after the spin is determined, at least in part, with assistance of the random number generator 232.

In some embodiments, payouts or other predetermined game outcomes (e.g., bonus spin opportunities, lottery bonus spin opportunities, prize wins, cash wins, re-spin bonus play, lottery numbers assigned to a user 124, etc.) may be determined based on a symbol combination that falls on a pay line that was subject to a wager prior to the spin. In some embodiments, a plurality of the pay lines may be selected for "play" prior to a spin, meaning that any pay line selected for "play" will be evaluated for a predetermined symbol combination. In some embodiments, if a bonus symbol 516 falls on a pay line subjected to a wager during a first game, then the user 124 that placed the wager may be assigned a lottery number or given a chance to try and win a lottery ticket by executing the lottery bonus instruction set 228.

As shown in FIG. 6, a user 124 may be allowed to play the first game and attempt to earn or win predetermined lottery numbers 604 assigned and displayed by a top ribbon of the display as one example of playing a combination slot game and lottery game. It should be appreciated that the predetermined lottery numbers 604 do not necessarily need to be displayed above the array of symbol areas 504.

In addition to displaying the predetermined lottery numbers 604, a counter 608 may also be displayed that provides the user 124 with an indication of a number of spins remaining to earn all of the predetermined lottery numbers 604. This particular type of combination slot and lottery game may enable a user 124 to win after each slot spin (e.g., after symbols 512, 516 are repositioned in each column 508), which may require a wager placed by the user 124 for each spin. The amount of credit available to a user 124 after any particular spin may be relatively small in comparison to an amount credit available to the user 124 after collecting all of the predetermined lottery numbers 604 (e.g., winning the lottery game).

The display of predetermined lottery numbers 604 may present the numbers required to win the lottery game. The numbers presented may be highlighted according to whether or not the user 124 has already collected or earned the particular number during a previous spin. In some embodiments, the highlighted numbers 612 may correspond to those numbers already collected by the user 124 during a spin and before the counter has reached the predetermined limit and non-highlighted numbers 616 may correspond to numbers yet to be collected by the user 124. Outcomes of the first game (e.g., the slot game) may correspond to inputs for the secondary game (e.g., the lottery game). In some embodiments, a user 124 may be awarded a jackpot prize (e.g., a progressive prize or maximum available payout from a lottery pay table) if the user 124 collects all of the predetermined lottery numbers 604 in a minimum number of spins. If the user 124 collects all of the predetermined lottery numbers 604 in more than the minimum number of spins but before the counter 608 reaches the predetermined limit (or counts down to zero), then the user 124 may win a prize that is less than the jackpot prize but calculated based on a pay table. Additional details of gaming methods and opportunities for the user 124 to play a combination slot and lottery game (or other combination of a first game and secondary game) will be described in further detail herein.

Figure 7:
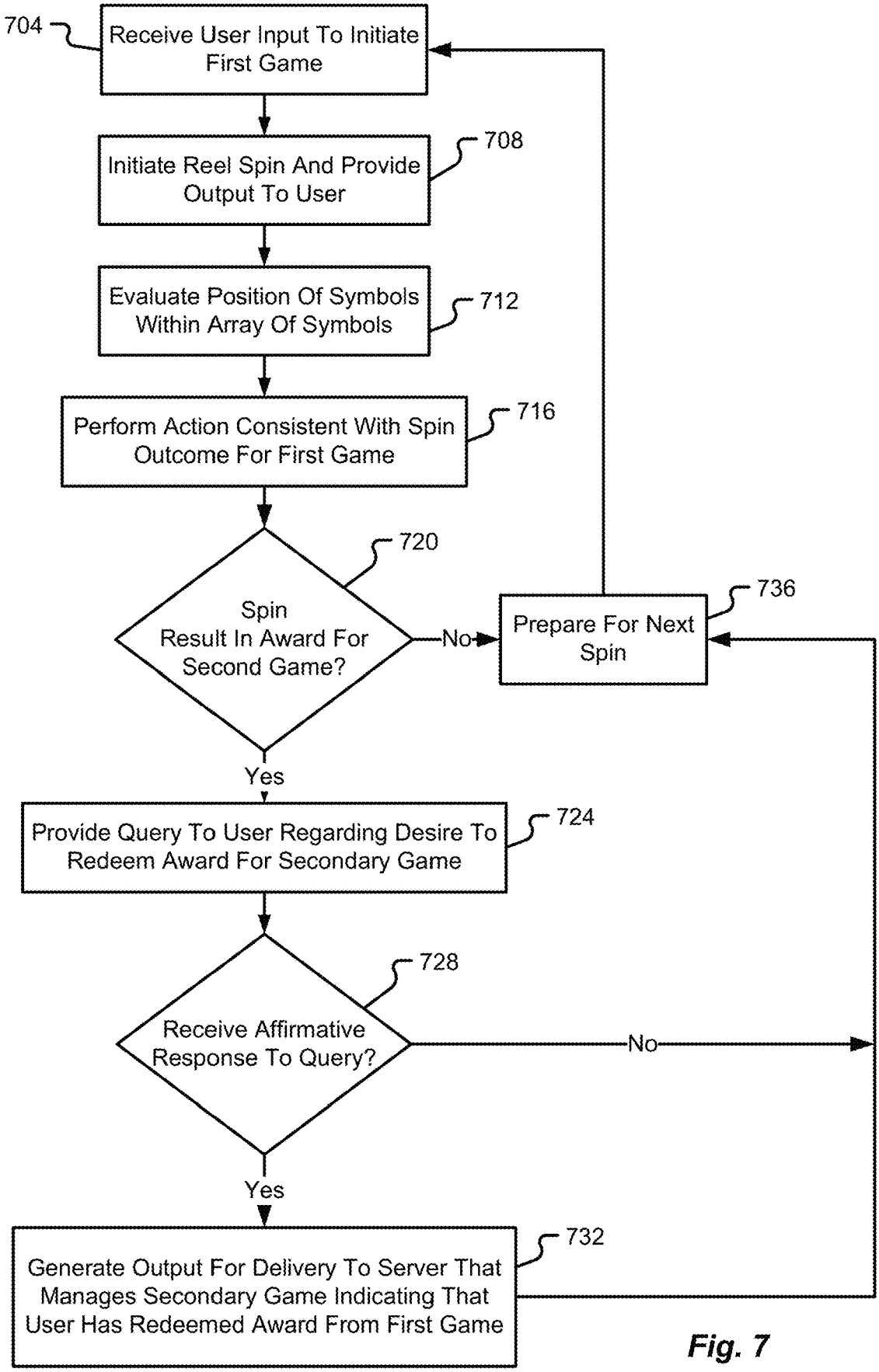
FIG. 7 is a flow chart illustrating a first gaming method in accordance with embodiments of the present disclosure.

With reference now to FIG. 7, additional details of a first gaming method will be described in accordance with embodiments of the present disclosure. The method begins when game play is initiated by a user 124 of the gaming device (e.g., gaming machine 112, mobile device 128, or some other type of device) (step 704). This step may occur in response to the user 124 selecting a predetermined button, inserting coins, cash, tickets, vouchers, etc., or performing some other action at the gaming device that indicates a desire to begin game play. The user's 124 input received at the gaming device may be received directly at the gaming device (e.g., via the user interface of the gaming device) or remotely (e.g., via the mobile device 128 where the mobile device 128 is used as a remote control of sorts for some other gaming device, such as a gaming machine 112). In some embodiments, the user input received at the gaming device may correspond to an input indicating a desire to place a wager or play a game credit.

The method may continue by the game instruction set 220 initiating a first spin (step 708). Upon initiating the first spin, the random number generator 232 may be utilized to determine an outcome of the first spin. After the first spin is completed, the game instruction set 220 may evaluate symbols 512, 516 laid out in the array of symbols 504 (step 712). The evaluation of symbols 512, 516 may include determining which pay lines will be subject to evaluation and whether any of the selected pay lines have a predetermined combination of symbols 512, 516 provided thereon. The evaluation of symbols 512, 516 may also include determining whether a bonus symbol 516 has landed at a predetermined symbol area (e.g., on a selected pay line).

Eventually, the game instruction set 220 will evaluate the symbols 512, 516 that land on a selected pay line or a plurality of selected pay lines to determine if the first spin resulted in a predetermined game outcome for the first game. The predetermined game outcome may include winning a prize, winning playing credit, winning money, winning a bonus spin, achieving a game achievement, etc. This evaluation after the execution of the first spin may cause the game instruction set 220 to perform an action consistent with the first spin outcome (step 716), if the first spin resulted in a predetermined game outcome.

The game instruction set 220 (or possibly the lottery bonus instruction set 228) will then determine whether the spin resulted in an award for a secondary game (e.g., a lottery game) (step 720). This may be answered positively if a bonus symbol 516 lands on a predetermined symbol area or on a selected pay line. Alternatively or additionally, this step may be answered positively if a predetermined set of symbols 512, 516 lands on a selected pay line.

If the query of step 720 is answered negatively, then the method continues with the gaming device preparing for the next spin in connection with the first game (step 736). If, on the other hand, the query of step 720 is answered positively, then the method continues with the gaming device providing a query to the user 124 regarding a desire (or lack thereof) to redeem the award for the secondary game, play the secondary game, etc. (step 724). In some embodiments, the award may correspond to an opportunity to execute a lottery bonus spin. In some embodiments, the award may correspond to receiving, selecting, or having one or more lottery numbers assigned to the user 124. It should be appreciated that the assignment of lottery numbers may be done with the assistance of a random number generator, based on the outcome of the first game (e.g., based on predetermined symbols 512, 516 landing on a predetermined symbol area or on a selected pay line), based on user selection criteria (e.g., user preferences 436), or a combination thereof.

The method may continue by waiting for an affirmative response to the query from the user 124 (step 728). If an affirmative response is not received (or a negative response is received), then the method may return to step 736, which may reset the method to wait for another user input to initiate the first game of chance again. However, if the query of step 728 is answered positively, then the method continues with the gaming device generating an output for delivery to the gaming server 116 that indicates the user 124 has redeemed the award from the first game in connection with playing the secondary game (step 732). In some embodiments, the output delivered to the gaming server 116 may identify the user 124, identify the mobile device 128, identify one or more lottery numbers assigned to the user 124, identify the outcome of the first game to enable the gaming server 116 to select a lottery number for the user 124, identify communication preferences/settings for the user 124/mobile device 128, or a combination thereof. The output may correspond to one or multiple messages that are transmitted to the gaming server 116 via the gaming network 104. Alternatively, the communication path of the message(s) may flow to the gaming server 116 through the mobile device 128 carried by the user 124 and then to the gaming server 116 via the communication network 108.

Figure 8:
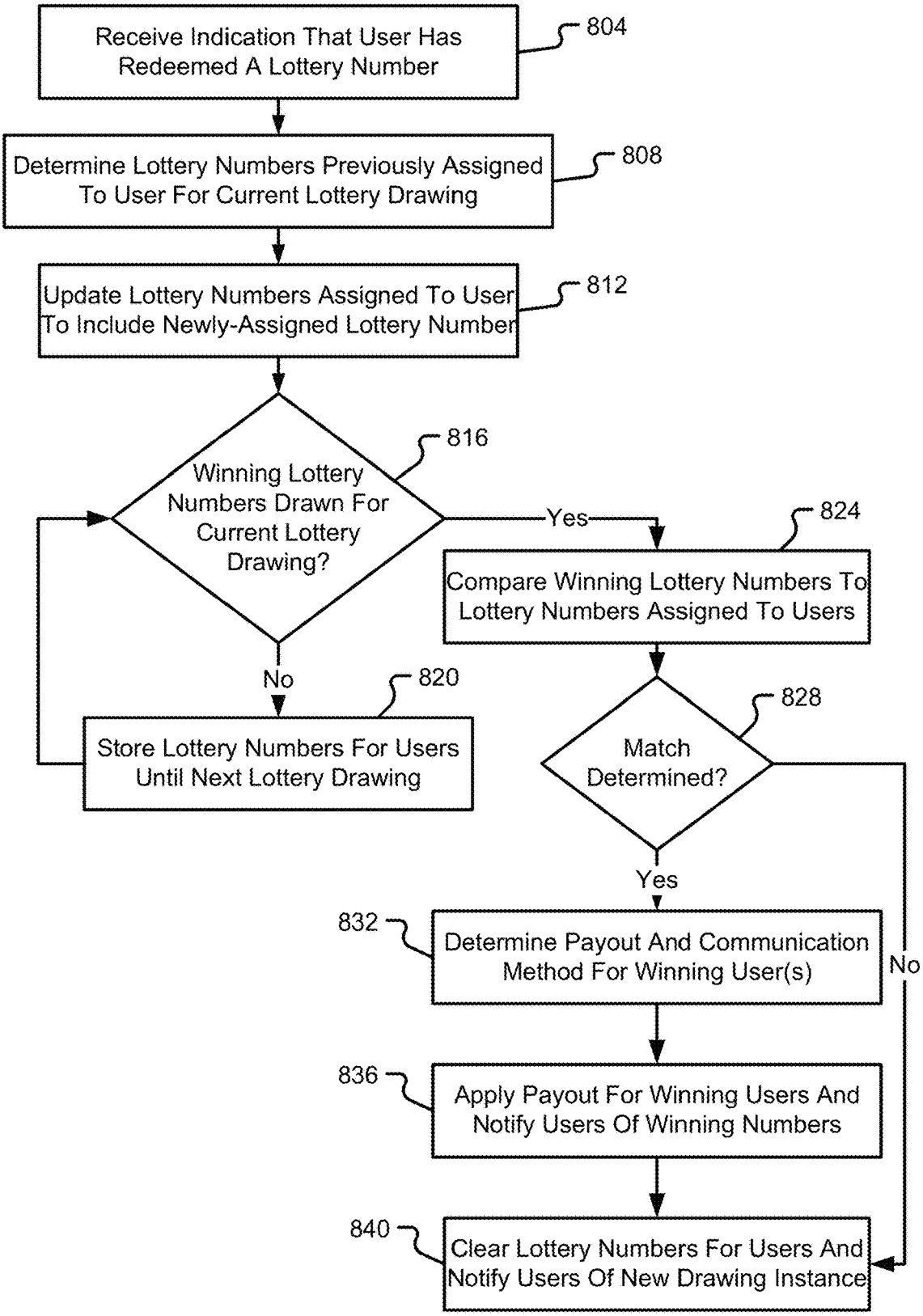
FIG. 8 is a flow chart illustrating a second gaming method in accordance with embodiments of the present disclosure.

With reference now to FIG. 8, another example of a gaming method will be described in accordance with at least some embodiments of the present disclosure. The method begins with the gaming server 116 receiving an indication that a user 124 has redeemed a lottery number while playing a first game (step 804). The user 124 may have been playing the first game on a gaming device. The indication that the user 124 has redeemed the lottery number (or a plurality of lottery numbers) may be received via the gaming network 104 or the communication network 108.

The method continues with the gaming server 116 determining the lottery numbers that had previously been assigned to the user 124 for the current lottery drawing (step 808). This determination may be made by requesting the information from the mobile device 128 of the user 124 (e.g., sending a request for the lottery numbers 428). Alternatively, the gaming server 116 may have maintained an internal table tracking lottery numbers and the users 124 to which the lottery numbers have been assigned. In either event, the gaming server 116 obtains the information identifying the lottery numbers previously assigned to the user 124 and updates the information associated with the user 124 to indicate that the user 124 has been assigned a new lottery number (step 812). This update may be registered in memory 208 of the gaming machine 112 being played by the user 124, in memory 308 of the gaming server 116, in memory 408 of the mobile device 128 owned or operated by the user 124, in memory of some other gaming device, or a combination thereof.

The method then continues with the gaming server 116 executing the lottery instruction set 320 to determine if it is time to execute a new lottery game (step 816). If it is not yet time to execute a new lottery game, the method continues with the gaming server 116 storing the lottery numbers assigned to the user 124 until the next drawing occurs (step 820).

Once the gaming server 116 determines that new winning lottery numbers should be drawn, the method continues with the gaming server 116 executing the lottery instruction set 320 to determine a new set of winning lottery numbers and comparing the winning lottery numbers with lottery numbers assigned to users 124 for the current lottery game (step 824). In some embodiments, the winning lottery numbers may be drawn with assistance of a random number generator, by selecting physical lottery balls from a collection of lottery balls, or the like. The gaming server 116 may then determine whether or not the winning lottery numbers are matched (entirely or partially) with lottery numbers assigned to one or more users 124 (step 828). If the query of step 828 is answered negatively, then the lottery numbers assigned to users 124 will be cleared from memory and users 124 that had lottery numbers assigned thereto will be notified that a drawing occurred and no winning users were selected (step 840).

Conversely, if the gaming server 116 determines that one or more users 124 were assigned lottery numbers that match some or all of the winning lottery numbers, then the gaming server 116 may determine a payout for those users 124 (e.g., based on how many of their assigned lottery numbers matched the winning lottery numbers) and determine an appropriate communication method for reaching the identified users 124 (step 832). The method may include determining a destination address for sending one or more messages to a mobile device 128 of the user 124, identifying a loyalty account associated with the user 124, identifying a gaming device at which the user 124 is currently positioned, or a combination thereof. The gaming server 116 then applies the determined payout for the winning user(s) 124 and notifies some or all of the users 124 that participated in the lottery game of the outcome (step 836). In some embodiments, both winning and non-winning users 124 may be notified of the outcome. In some embodiments, only those users 124 having winning lottery numbers may receive directed communications whereas the non-winning users 124 may only receive a general notification (e.g., as a generic display on all gaming device executing the improved lottery game described herein). The method then proceeds to step 840 where all previously-assigned lottery numbers are cleared and a new lottery game instance can begin.

Figure 9:
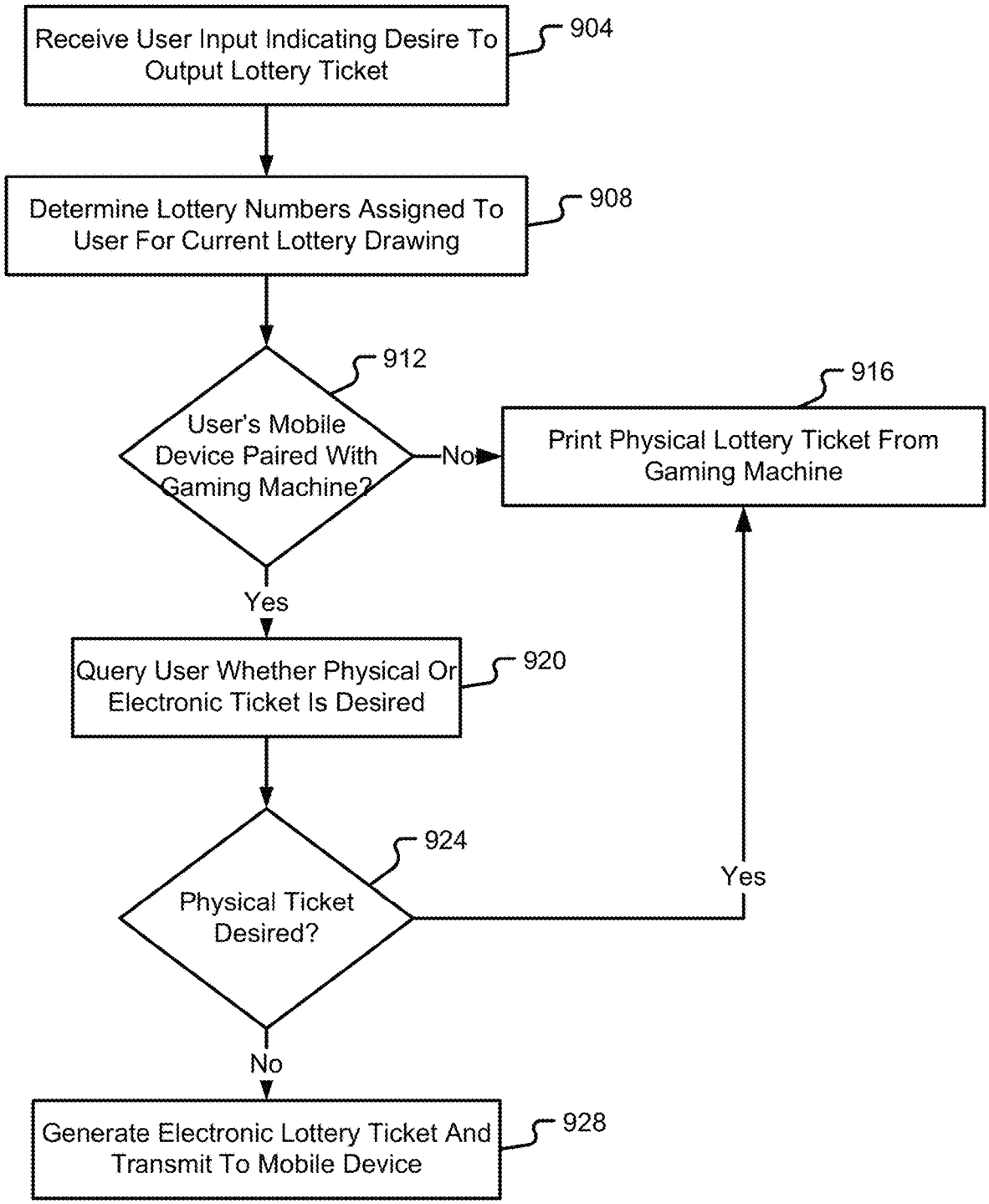
FIG. 9 is a flow chart illustrating a third gaming method in accordance with embodiments of the present disclosure.

With reference now to FIG. 9, another gaming method will be described in accordance with embodiments of the present disclosure. The method begins when a user 124 input is received at a gaming machine 112 indicating a desire for the gaming device to output a lottery ticket (step 904). The user 124 input may be received at the user interface 216 of the gaming device.

The method continues with the gaming device determining the lottery numbers that have been assigned to the user 124 for the current instance of lottery drawing (step 908). This determination may be made by referencing the lottery numbers 428, by sending a query to the gaming server 116, and/or by referencing internal memory 208. The lottery numbers that are assigned to the user 124 may correspond to a single set of lottery numbers (e.g., one lottery entry) or a plurality of sets of lottery numbers (e.g., a plurality of lottery entries).

The method then continues with the gaming device determining whether a mobile device 128 is currently paired with the gaming device, which may be provided as a gaming machine 112 (step 912). This determination may be made based on determining whether or not the mobile device 128 is communicating with the gaming machine 112 using a proximity-based communication protocol, thereby indicating that the mobile device 128 is within a predetermined proximity of the gaming machine 112.

If the query of step 912 is answered negatively, then the gaming device defaults to a mode whereby a physical lottery ticket is printed from the gaming device (step 916). The physical lottery ticket printed by the gaming device may include various types of information such as lottery numbers assigned to the user 124, an identifier associated with the user 124, a timestamp or date on which the lottery ticket was printed, an identifier of the gaming device that printed the lottery ticket, or a combination thereof. In some embodiments, when the gaming device prints the physical lottery ticket, the gaming device may report such a printing action back to the gaming server 116, thereby enabling the game server 116 to track which lottery numbers were assigned to the user 124 when the lottery ticket was printed.

If the query of step 912 is answered affirmatively, then the method may continue with the gaming device providing a query to the user 124 regarding the user's 124 desire to have a physical lottery ticket printed or an electronic ticket issued (step 920). The gaming device then makes a determination as to whether or not to print a physical ticket based on the user's 124 response to the query of step 920 (step 924). If the gaming device determines that the user 124 desires a physical ticket even though the mobile device 128 was paired thereto, then the gaming device will issue a physical ticket at step 916. However, if the gaming device determines that the user 124 desires an electronic ticket, then the gaming machine may generate the electronic lottery ticket and deliver the electronic lottery ticket to the mobile device 128 (step 928). In some embodiments, the electronic lottery ticket is issued to the mobile device 128 using the communication channel established vis-à-vis the pairing between the gaming machine 112 and mobile device 128. Alternatively or additionally, the gaming machine 112 may provide information to the gaming server 116 that causes the gaming server 116 to issue the electronic lottery ticket. Thus, in some embodiments, issuance or outputting of a lottery ticket may include physically printing a lottery ticket with lottery numbers associated therewith, assigning lottery numbers with an electronic lottery ticket number and storing the lottery numbers in association with the electronic lottery ticket in memory, or a combination of such issuance actions.

Figure 10:
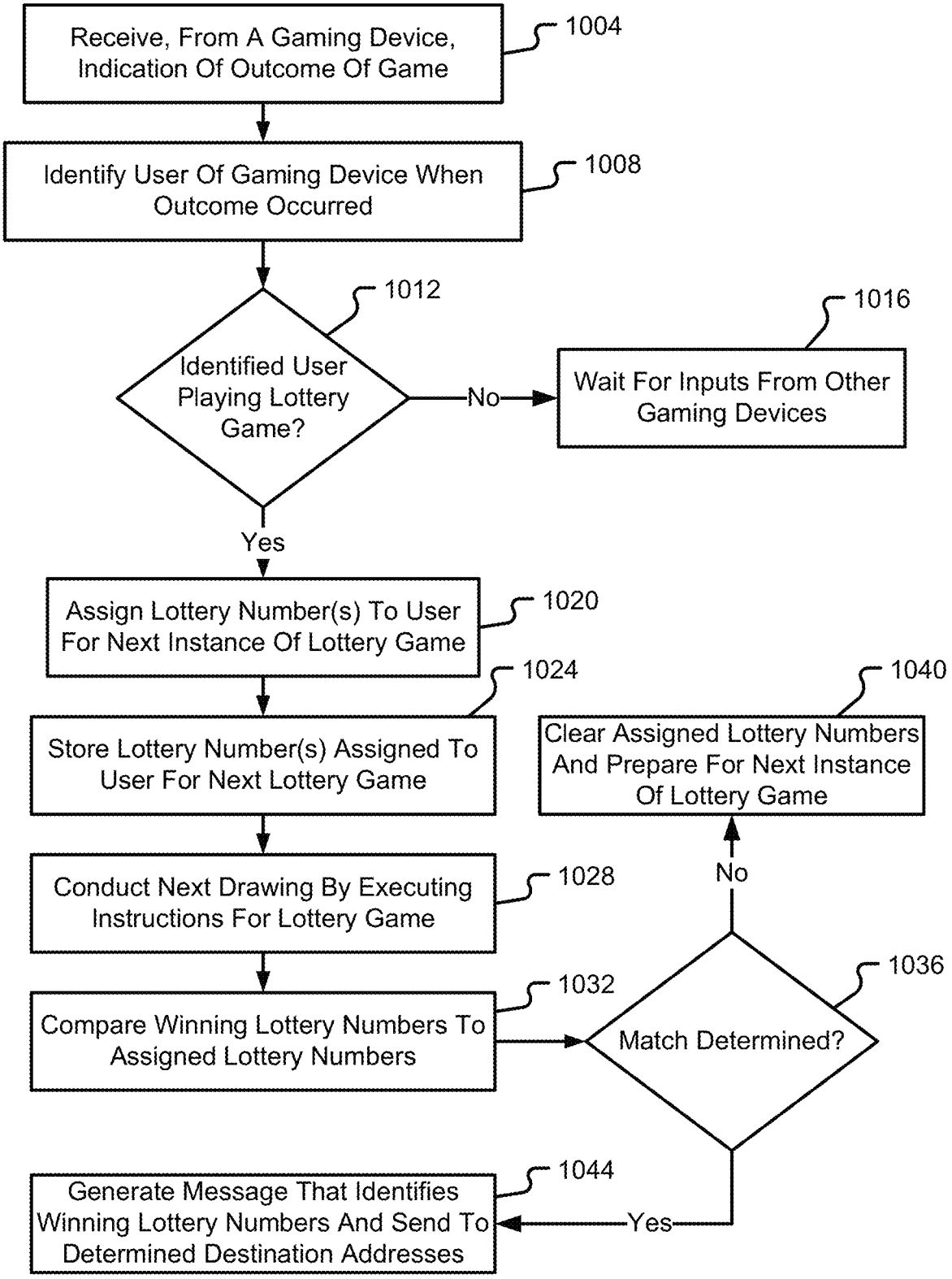
FIG. 10 is a flow chart illustrating a fourth gaming method in accordance with embodiments of the present disclosure.

With reference now to FIG. 10, another gaming method will be described in accordance with embodiments of the present disclosure. The method begins with the gaming server 116 receiving, from a gaming machine 112, an indication of an outcome of a slot game being played at the gaming machine 112 (step 1004). Alternatively or additionally, this step may involve the user 124 playing a slot game on a mobile device 128 or with a combination of a mobile device 128 and gaming machine 112 and the indication may be received from one or both of the mobile device 128 and gaming machine 112. It should be appreciated that the slot game may be played on any type of gaming device or combination of devices without departing from the scope of the present disclosure.

The method continues with the gaming server 116 identifying the user 124 that was playing the slot game when the outcome occurred (step 1008). If a pairing existed between the gaming machine 112 and user's 124 mobile device 128, then the gaming machine 112 may provide information describing the user's 124 mobile device 128, a player loyalty account for the user 124, or any other information that describes the user 124.

The method then continues with the gaming server 116 determining whether the identified user 124 is also playing or wanting to play the lottery game (step 1012). If this query is answered negatively, then the method continues with the gaming server 116 waiting for additional inputs from other (or the same) gaming machines 112 (step 1016).

If the query of step 1012 is answered affirmatively, however, the method then continues with the gaming server 116 assigning one or more lottery numbers to the user 124 for the next instance of the lottery game (step 1020). The assigned lottery numbers may be assigned randomly, based on inputs from the user 124, based on the outcome of the slot game, or a combination thereof. The assigned lottery number(s) may then be stored in memory 308 of the gaming server 116 or in a remote database (step 1024).

At some point after the lottery number(s) have been assigned to the user 124, the method continues with the gaming server 116 executing the lottery instruction set 320 and conducting the next lottery drawing (step 1028). Based on the execution of the lottery instruction set 320 (or some other mechanism for selecting winning lottery numbers), the method continues with the gaming server 116 comparing the winning lottery numbers with the lottery numbers assigned to the various users 124 playing the lottery game (step 1032).

Based on the comparison in step 1032, the gaming server 116 determines if any user 124 has one or more lottery numbers assigned thereto that match the winning lottery numbers (step 1036). If the query of step 1036 is answered negatively, then the method continues with the gaming server 116 clearing the assigned lottery numbers from memory (or otherwise marking such numbers with a date on which the lottery numbers were played) and then the gaming server 116 prepares for the next instance of the lottery game (step 1040).

If, on the other hand, the query of step 1036 is answered positively, then the gaming server 116 can generate one or more messages that identify the winning lottery number(s), the user(s) 124 to which the winning numbers were assigned, and destination addresses for communicating with the winning user(s) 124 (step 1044). The message generated at the gaming server 116 may then be sent to the determined destination addresses, which may correspond to addresses of a mobile device 128, a gaming machine 112, a gaming device, or a combination thereof. Alternatively or additionally, the destination addresses may correspond to email addresses, phone numbers (for a phone call or text message), a web address, a social media identifier, etc.

In various embodiments described herein, the first game provided to and played by a user may correspond to a slot game. As can be appreciated, when a user plays a slot game on a gaming device, the gaming device provides one or more awards after a spin of the reels when specified types and/or configurations of the indicia or symbols on the reels occur on an active pay line or otherwise occur in a winning pattern, occur on the requisite number of adjacent reels, and/or occur in a scatter pay arrangement. In some situations, the award may correspond to a monetary award whereas in other situations the award may correspond to an opportunity to play a secondary game (e.g., a lottery game). As noted above, embodiments of the present disclosure are not limited to these specific types of games (e.g., slot games and lottery games), but rather can be applied to any combination of games that use any combination of pay determinations.

In certain embodiments, the gaming device employs a ways to win award determination. In these embodiments, any outcome to be provided is determined based on a number of associated symbols that are generated in active symbol display areas on the requisite number of adjacent reels (i.e., not on pay lines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations," which are incorporated herein by reference.

In various embodiments, the gaming device includes a progressive award. Typically, a progressive award includes an initial amount and an additional amount funded through a portion of each wager placed to initiate a play of a primary game. When one or more triggering events occurs, the gaming device provides at least a portion of the progressive award. After the gaming device provides the progressive award, an amount of the progressive award is reset to the initial amount and a portion of each subsequent wager is allocated to the next progressive award. Examples of progressive gaming systems or gaming devices are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards," which are incorporated herein by reference. As noted above, the progressive awards may be available to users that play the secondary game, but may not necessarily be available to players that play the first game.

As generally noted above, in addition to providing winning credits or other awards for one or more plays of the primary game(s), in various embodiments the gaming device provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). The secondary game(s) may be any type of suitable game, either similar to or completely different from the primary game.

In various embodiments, the gaming device automatically provides or initiates the secondary game upon the occurrence of a triggering event or the satisfaction of a qualifying condition. In other embodiments, the gaming device initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a pay line following a spin of the reels for a play of the primary game. In other embodiments, the triggering event or qualifying condition occurs based on a certain amount of game play (such as number of games, number of credits, amount of time) being exceeded, or based on a specified number of points being earned during game play. Any suitable triggering event or qualifying condition or any suitable combination of a plurality of different triggering events or qualifying conditions may be employed.

In other embodiments, at least one processor of the gaming device randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming device determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win," which are incorporated herein by reference.

In various embodiments, the gaming system or gaming device includes one or more player tracking systems. Such player tracking systems enable operators of the gaming system or gaming device (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming device to begin a gaming session, the card reader reads the player identification number off the player tracking card to identify the player. The gaming device timely tracks any suitable information or data relating to the identified player's gaming session. The gaming device also timely tracks when the player tracking card is removed to conclude play for that gaming session. In another embodiment, rather than requiring insertion of a player tracking card into the card reader, the gaming device utilizes one or more portable devices, such as a mobile phone, a radio frequency identification tag, or any other suitable wireless device, to track when a gaming session begins and ends. In another embodiment, the gaming device utilizes any suitable biometric technology or ticket technology to track when a gaming session begins and ends.

In such embodiments, during one or more gaming sessions, the gaming device tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the first display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services," which are incorporated herein by reference.

Certain of the gaming systems described herein, including gaming device located in a casino or another gaming establishment, include certain components and/or are configured to operate in certain manners that differentiate these gaming devices and systems from general purpose computing devices (i.e., certain personal gaming devices such as desktop computers and laptop computers).

For instance, gaming devices are highly regulated to ensure fairness and, in many cases, gaming devices, such as gaming machines 112, are configured to award monetary awards up to multiple millions of dollars. To satisfy security and regulatory requirements in a gaming environment, hardware and/or software architectures are implemented in EGMs that differ significantly from those of general-purpose computing devices. For purposes of illustration, a description of gaming devices relative to general-purpose computing devices and some examples of these additional (or different) hardware and/or software architectures found in gaming devices are described herein.

At first glance, one might think that adapting general-purpose computing device technologies to the gaming industry and gaming devices would be a simple proposition because both general purpose computing devices and gaming devices employ processors that control a variety of devices. However, due to at least: (1) the regulatory requirements placed on gaming devices, (2) the harsh environment in which gaming devices operate, (3) security requirements, and (4) fault tolerance requirements, adapting general purpose computing device technologies to gaming devices can be quite difficult. Further, techniques and methods for solving a problem in the general-purpose computing device industry, such as device compatibility and connectivity issues, might not be adequate in the gaming industry. For instance, a fault or a weakness tolerated in a general-purpose computing device, such as security holes in software or frequent crashes, is not tolerated in a gaming device because in a gaming device these faults can lead to a direct loss of funds from the gaming device, such as stolen cash or loss of revenue when the gaming device is not operating properly or when the random outcome determination is manipulated.

Certain differences between general-purpose computing devices and gaming devices are described below. A first difference between gaming devices and general-purpose computing devices is that gaming devices are state-based systems. A state-based system stores and maintains its current state in a non-volatile memory such that, in the event of a power failure or other malfunction, the state-based system can return to that state when the power is restored or the malfunction is remedied. For instance, for a state-based gaming device, if the gaming device displays an award for a game of chance but the power to the gaming device fails before the gaming device provides the award to the player, the gaming device stores the pre-power failure state in a non-volatile memory, returns to that state upon restoration of power, and provides the award to the player. This requirement affects the software and hardware design on gaming devices. General-purpose computing devices are typically not state-based machines, and a majority of data can be lost when a malfunction occurs on a general-purpose computing device.

A second difference between gaming devices and general-purpose computing devices is that, for regulatory purposes, the software on the gaming device utilized to operate the gaming device has been designed to be static and monolithic to prevent cheating by the operator of the gaming device. For instance, one solution that has been employed in the gaming industry to prevent cheating and to satisfy regulatory requirements has been to manufacture a gaming device that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the gaming device in the presence of a gaming regulator. Regardless of whether the EPROM solution is used, to gain approval in most gaming jurisdictions, a gaming device must demonstrate sufficient safeguards that prevent an operator or a player of a gaming device from manipulating the gaming device's hardware and software in a manner that gives him an unfair, and in some cases illegal, advantage.

A third difference between gaming devices and general-purpose computing devices is authentication-gaming devices storing code are configured to authenticate the code to determine if the code is unaltered before executing the code. If the code has been altered, the gaming device prevents the code from being executed. The code authentication requirements in the gaming industry affect both hardware and software designs on gaming devices. Certain gaming devices use hash functions to authenticate code. For instance, one gaming device stores game program code, a hash function, and an authentication hash (which may be encrypted). Before executing the game program code, the gaming device hashes the game program code using the hash function to obtain a result hash and compares the result hash to the authentication hash. If the result hash matches the authentication hash, the gaming device determines that the game program code is valid and executes the game program code. If the result hash does not match the authentication hash, the gaming device determines that the game program code has been altered (i.e., may have been tampered with) and prevents execution of the game program code. Examples of gaming device code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes," which are incorporated herein by reference.

A fourth difference between gaming devices and general-purpose computing devices is that gaming devices have unique peripheral device requirements that differ from those of a general-purpose computing device, such as peripheral device security requirements not usually addressed by general-purpose computing devices. For instance, monetary devices, such as coin dispensers, bill validators, and ticket printers and computing devices that are used to govern the input and output of cash or other items having monetary value (such as tickets) to and from a gaming device have security requirements that are not typically addressed in general purpose computing devices. Therefore, many general-purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain gaming devices use a watchdog timer to provide a software failure detection mechanism. In a normally-operating gaming device, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain gaming devices use several power supply voltages to operate portions of the computer circuitry. These can be generated in a central power supply or locally on the computer board. If any of these voltages falls out of the tolerance limits of the circuitry they power, unpredictable operation of the gaming device may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain gaming devices have power supplies with relatively tighter voltage margins than that required by the operating circuitry. In addition, the voltage monitoring circuitry implemented in certain gaming devices typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the gaming device.

As described above, certain gaming devices are state-based machines. Different functions of the game provided by the gaming device (e.g., bet, play, result, points in the graphical presentation, etc.) may be defined as a state. When the gaming device moves a game from one state to another, the gaming device stores critical data regarding the game software in a custom non-volatile memory subsystem. This ensures that the player's wager and credits are preserved and to minimize potential disputes in the event of a malfunction on the gaming device. In general, the gaming device does not advance from a first state to a second state until critical information that enables the first state to be reconstructed has been stored. This feature enables the gaming device to recover operation to the current state of play in the event of a malfunction, loss of power, etc. that occurred just prior to the malfunction. In at least one embodiment, the gaming device is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the gaming device memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve gaming device critical data, although other types of non-volatile memory devices may be employed. These memory devices are typically not used in typical general purpose computing devices.

Thus, in at least one embodiment, the gaming device is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of gaming device critical information) within a time period of 200 milliseconds or less. In at least one embodiment, the time period of 200 milliseconds represents a maximum amount of time for which sufficient power may be available to the various gaming device components after a power outage event has occurred at the gaming device.

As described previously, the gaming device may not advance from a first state to a second state until critical information that enables the first state to be reconstructed has been atomically stored. After the state of the gaming device is restored during the play of a game of chance, game play may resume and the game may be completed in a manner that is no different than if the malfunction had not occurred. Thus, for example, when a malfunction occurs during a game of chance, the gaming device may be restored to a state in the game of chance just prior to when the malfunction occurred. The restored state may include metering information and graphical information that was displayed on the gaming device in the state prior to the malfunction. For example, when the malfunction occurs during the play of a card game after the cards have been dealt, the gaming device may be restored with the cards that were previously displayed as part of the card game. As another example, a bonus game may be triggered during the play of a game of chance in which a player is required to make a number of selections on a video display screen. When a malfunction has occurred after the player has made one or more selections, the gaming device may be restored to a state that shows the graphical presentation just prior to the malfunction including an indication of selections that have already been made by the player. In general, the gaming device may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the gaming device and the state of the gaming device (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming device prior to, during, and/or after the disputed game to demonstrate whether the player was correct or not in her assertion. Examples of a state-based gaming device, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play," which are incorporated herein by reference.

Another feature of gaming devices is that they often include unique interfaces, including serial interfaces, to connect to specific subsystems internal and external to the gaming device. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the gaming device, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between gaming devices. As another example, SAS is a communication protocol used to transmit information, such as metering information, from an gaming device to a remote device. Often SAS is used in conjunction with a player tracking system.

Certain gaming devices may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an gaming device by monitoring security switches attached to access doors in the gaming device cabinet. Access violations result in suspension of game play and can trigger additional security operations to preserve the current state of game play. These circuits also function when power is off by use of a battery backup. In power-off operation, these circuits continue to monitor the access doors of the gaming device. When power is restored, the gaming device can determine whether any security violations occurred while power was off, e.g., via software for reading status registers. This can trigger event log entries and further data authentication operations by the gaming device software.

Trusted memory devices and/or trusted memory sources are included in an gaming device to ensure the authenticity of the software that may be stored on less secure memory subsystems, such as mass storage devices. Trusted memory devices and controlling circuitry are typically designed to not enable modification of the code and data stored in the memory device while the memory device is installed in the gaming device. The code and data stored in these devices may include authentication algorithms, random number generators, authentication keys, operating system kernels, etc. The purpose of these trusted memory devices is to provide gaming regulatory authorities a root trusted authority within the computing environment of the gaming device that can be tracked and verified as original. This may be accomplished via removal of the trusted memory device from the gaming device computer and verification of the secure memory device contents is a separate third party verification device. Once the trusted memory device is verified as authentic, and based on the approval of the verification algorithms included in the trusted device, the gaming device is enabled to verify the authenticity of additional code and data that may be located in the gaming computer assembly, such as code and data stored on hard disk drives. Examples of trusted memory devices are described in U.S. Pat. No. 6,685,567, entitled "Process Verification," which is incorporated herein by reference.

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment," which is incorporated herein by reference.

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, gaming devices that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System," which is incorporated herein by reference.

It should further be appreciated that the gaming device of the present disclosure may have varying or alternative housing configurations.

It should further be appreciated that the gaming device of the present disclosure may have varying or alternative display device configurations.

In various embodiments, the gaming device of the present disclosure is configured to be positioned on a base or stand.

It should be appreciated that the enhanced physical player interaction provided by the present disclosure, in addition to being implemented in an gaming device configured to be located on a casino floor, can be implemented in one or more personal gaming devices, such as desktop computers, laptop computers, tablet computers or computing devices, personal digital assistants, mobile phones, and other mobile computing devices.

Various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The invention is claimed as follows:

1. A method of facilitating user interactions with a gaming device, the method comprising:

receiving a first user input at the gaming device, wherein the first user input comprises an indication of a wager amount desired by a user for a first game executed by the gaming device;

invoking, with a processor of the gaming device, a random number generator to generate an outcome for the first game;

providing, with the processor, an output to the user that indicates the outcome for the first game;

determining, with the processor, that the outcome for the first game qualifies the user to receive an award that is an input for a secondary game, wherein the secondary game is different from the first game, and wherein the input for the secondary game comprises a number;

providing, with the processor, a query to the user requesting whether the user desires to participate in the secondary game;

receiving a second user input at the gaming device, wherein the second user input comprises a response to the query;

in response to receiving the second user input, generating an output at the gaming device for a server that manages the secondary game, wherein the gaming device is hosted by a first entity, wherein the server that manages the secondary game is hosted by a second entity that is different from the first entity, and wherein the output comprises an indication that the user is participating in the secondary game based on the response to the query; and automatically transmitting the output from the gaming device to the server that manages the secondary game, wherein the output is transmitted across at least one of a gaming network administered by the first entity and a communication network that is considered untrusted from a perspective of the gaming network.

2. The method of claim 1, further comprising:

updating in memory, with the processor, a set of numbers that have been assigned to the user to include the number; and providing, with the processor, a display to the user that identifies the set of numbers inclusive of the number.

3. The method of claim 2, further comprising:

receiving a third user input at the gaming device, wherein the third user input comprises an indication to output a ticket;

in response to receiving the third user input at the gaming device, providing the set of numbers inclusive of the number to the server that manages the secondary game; and outputting the ticket at the gaming device with the set of numbers inclusive of the number.

4. The method of claim 3, wherein outputting the ticket comprises printing a ticket with the set of numbers inclusive of the number.

5. The method of claim 2, further comprising:

determining that a mobile device associated with the user is paired with the gaming device; and providing the mobile device with a message that identifies the set of numbers inclusive of the number.

6. The method of claim 2, wherein the number comprises a randomly-generated number.

7. The method of claim 2, wherein the number comprises a number selected by the user.

8. The method of claim 2, wherein the number is determined based on the outcome for the first game.

9. The method of claim 2, further comprising:

executing, at the server, the secondary game and determining a winning set of numbers;

comparing, at the server, the winning set of numbers with the set of numbers inclusive of the number;

determining, at the server and based on the comparison, that the set of numbers inclusive of the number matches the winning set of numbers;

generating, at the server, a message that indicates the set of numbers inclusive of the number matches the winning set of numbers; and sending the message to a mobile device associated with the user.

10. The method of claim 1, wherein the first game comprises a slot game, wherein the number is awarded with an expiration time that coincides with execution of the secondary game, and wherein the output comprises a message that is transmitted to the server via a communication network.

11. A method of facilitating a lottery game, comprising:

executing, with a processor, instructions for a lottery game;

receiving, from a gaming device at the processor, an indication of an outcome of a game that was executed by the gaming device, wherein the gaming device is hosted by a first entity, wherein the lottery game is hosted by a second entity that is different from the first entity, wherein the communication network is considered untrusted from a perspective of a gaming network to which the gaming device is connected;

identifying, with the processor, a user of the gaming device when the outcome of the game occurred;

assigning, with the processor, a lottery number to the user of the gaming device for a next execution of the lottery game, wherein the lottery number is selected based on the outcome of the game;

storing, with the processor, the lottery number assigned to the user with a set of lottery numbers inclusive of the lottery number;

comparing, with the processor, a set of winning lottery numbers determined from the next execution of the lottery game with the set of lottery numbers inclusive of the lottery number; and notifying, with the processor, the user in response to the set of winning lottery numbers matching the set of lottery numbers inclusive of the lottery number.

12. The method of claim 11, wherein notifying the user comprises:

generating a message that identifies the set of winning lottery numbers;

determining a destination address for the message, wherein the destination address is determined based on a device association with the user; and transmitting the message to the destination address.

13. The method of claim 12, wherein the destination address comprises an address of a mobile device that is associated with the user and wherein the mobile device is determined by a pairing between the mobile device and the gaming device at a time the gaming device executed the game.

14. The method of claim 11, further comprising:

receiving, from the gaming device at the processor, a second indication of a second outcome of a game that was executed by the gaming device;

assigning, with the processor, a second lottery number to the user of the gaming device for the next execution of the lottery game; and storing, with the processor, the second lottery number assigned to the user with the set of lottery numbers inclusive of the lottery number.

* * * * *